US012402689B2

(12) United States Patent
Langvin et al.

(10) Patent No.: US 12,402,689 B2
(45) Date of Patent: Sep. 2, 2025

(54) FOOTWEAR WITH JOINTED SOLE STRUCTURE FOR EASE OF ACCESS

(71) Applicant: NIKE, Inc., Beaverton, OR (US)

(72) Inventors: Elizabeth Langvin, Sherwood, OR (US); MiYoung Ma, Busan (KR); YeonGon Kim, Gimhae (KR)

(73) Assignee: NIKE, Inc., Beaverton, OR (US)

( * ) Notice: Subject to any disclaimer, the term of this patent is extended or adjusted under 35 U.S.C. 154(b) by 37 days.

(21) Appl. No.: 18/519,289

(22) Filed: Nov. 27, 2023

(65) Prior Publication Data

US 2024/0172836 A1 May 30, 2024

Related U.S. Application Data

(60) Provisional application No. 63/428,370, filed on Nov. 28, 2022.

(51) Int. Cl.
*A43B 11/00* (2006.01)
*A43B 13/14* (2006.01)

(52) U.S. Cl.
CPC ..... *A43B 11/00* (2013.01); *A43B 13/141* (2013.01)

(58) Field of Classification Search
None
See application file for complete search history.

(56) References Cited

U.S. PATENT DOCUMENTS 4,497 A 5/1846 Vetter
75,048 A 3/1868 Perley
171,301 A 12/1875 McKee
417,460 A 12/1889 Wurtele
474,574 A 5/1892 Bruzon
503,588 A 8/1893 Elterich et al.
537,627 A 4/1895 Bixby et al.
558,937 A 4/1896 Edmonds
808,948 A 1/1906 Roberts
827,330 A 7/1906 Tillson
863,549 A 8/1907 Metz
(Continued)

FOREIGN PATENT DOCUMENTS

AU 439212 B2 8/1973
CN 87209219 U 5/1988
(Continued)

OTHER PUBLICATIONS

Aidin H., Under Armour's Innovative Fall/Winter 2016 Collection Now Available at All Brand Houses, Aug. 27, 2016, https://www.runsociety.com/news/under-armours-innovative-fallwinter-2016-collection-now-available-at-all-brand-houses/ (accessed Nov. 4, 2017).
(Continued)

*Primary Examiner* — Jila M Mohandesi
(74) *Attorney, Agent, or Firm* — Quinn IP Law

(57) ABSTRACT

An article of footwear includes a sole structure that has a front midsole component and a rear midsole component. A hinge connects the front midsole component to the rear midsole component and is disposed in a groove defined between the front and rear midsole components at a lower. The front midsole component and the rear midsole component are pivotable relative to one another at the groove between a use position and an access position, with the groove relatively open in the use position, and the groove relatively closed in the access position.

20 Claims, 13 Drawing Sheets

(56) References Cited

U.S. PATENT DOCUMENTS

| | | | |
|---|---|---|---|
| 955,337 | A | 4/1910 | Lawlor |
| 1,081,678 | A | 12/1913 | Langerak |
| 1,494,236 | A | 5/1924 | Greathouse |
| 1,585,049 | A | 5/1926 | Skoglund |
| 1,603,144 | A | 10/1926 | Nichols |
| 1,686,175 | A | 10/1928 | Read |
| 1,812,622 | A | 6/1931 | Costello |
| 2,069,752 | A | 2/1937 | Dorr |
| 2,252,315 | A | 8/1941 | Doree |
| 2,302,596 | A | 11/1942 | Bigio |
| 2,357,980 | A | 9/1944 | Spiro |
| 2,450,250 | A | 9/1948 | Napton |
| 2,452,502 | A | 10/1948 | Tarbox |
| 2,452,649 | A | 11/1948 | Graves |
| 2,487,227 | A | 11/1949 | Eberle |
| 2,619,744 | A | 12/1952 | Mattes |
| 2,693,039 | A | 11/1954 | Balut |
| 2,736,110 | A | 2/1956 | Hardimon |
| 2,746,178 | A | 5/1956 | Miller et al. |
| 2,825,155 | A | 3/1958 | Hines |
| 2,920,402 | A | 1/1960 | Minera |
| 3,039,207 | A | 6/1962 | Lincors |
| 3,146,535 | A | 9/1964 | Owings |
| 3,192,651 | A | 7/1965 | Smith |
| 3,283,423 | A | 11/1966 | Schovee |
| 3,349,505 | A | 10/1967 | Lopez |
| 3,400,474 | A | 9/1968 | Tendler |
| 3,436,842 | A | 4/1969 | Sachs |
| 3,681,860 | A | 8/1972 | Bidegain |
| 4,095,356 | A | 6/1978 | Robran et al. |
| 4,136,468 | A | 1/1979 | Munschy |
| 4,309,832 | A | 1/1982 | Hunt |
| 4,489,509 | A | 12/1984 | Libit |
| 4,507,879 | A | 4/1985 | Dassler |
| 4,559,724 | A | 12/1985 | Norton |
| 4,562,651 | A | 1/1986 | Frederick et al. |
| 4,573,457 | A | 3/1986 | Parks |
| 4,594,798 | A | 6/1986 | Autry et al. |
| 4,599,811 | A | 7/1986 | Rousseau |
| 4,615,126 | A | 10/1986 | Mathews |
| 4,649,656 | A | 3/1987 | Cox et al. |
| 4,665,634 | A | 5/1987 | Diaz |
| 4,776,111 | A | 10/1988 | Crowley |
| 4,944,099 | A | 7/1990 | Davis |
| 4,959,914 | A | 10/1990 | Hilgarth |
| 4,972,613 | A | 11/1990 | Loveder |
| 5,054,216 | A | 10/1991 | Lin |
| 5,060,401 | A | 10/1991 | Whatley |
| 5,090,140 | A | 2/1992 | Sessa |
| 5,127,170 | A | 7/1992 | Messina |
| 5,152,082 | A | 10/1992 | Culpepper |
| 5,181,331 | A | 1/1993 | Berger |
| D333,377 | S | 2/1993 | Hatfield |
| 5,184,410 | A | 2/1993 | Hamilton |
| 5,222,313 | A | 6/1993 | Dowdy et al. |
| 5,279,051 | A | 1/1994 | Whatley |
| 5,282,327 | A | 2/1994 | Ogle |
| 5,341,583 | A | 8/1994 | Hallenbeck |
| 5,345,698 | A | 9/1994 | Billet et al. |
| 5,371,957 | A | 12/1994 | Gaudio |
| 5,467,537 | A | 11/1995 | Aveni et al. |
| 5,481,814 | A | 1/1996 | Spencer |
| 5,557,866 | A | 9/1996 | Prengler |
| 5,570,523 | A | 11/1996 | Lin |
| 5,682,687 | A | 11/1997 | Arai |
| 5,724,265 | A | 3/1998 | Hutchings |
| 5,813,144 | A | 9/1998 | Prengler |
| 5,842,292 | A | 12/1998 | Siesel |
| 5,884,420 | A | 3/1999 | Donnadieu |
| 5,955,667 | A | 9/1999 | Fyfe |
| 5,983,530 | A | 11/1999 | Chou |
| 5,997,027 | A | 12/1999 | Jungkind |
| 6,000,148 | A | 12/1999 | Cretinon |
| 6,018,705 | A | 1/2000 | Gauidet et al. |
| 6,052,654 | A | 4/2000 | Gaudet et al. |
| 6,189,239 | B1 | 2/2001 | Gasparovic et al. |
| 6,290,559 | B1 | 9/2001 | Scott |
| 6,298,582 | B1 | 10/2001 | Friton et al. |
| 6,378,230 | B1 | 4/2002 | Rotem et al. |
| 6,430,843 | B1 | 8/2002 | Potter et al. |
| 6,438,872 | B1 | 8/2002 | Chil et al. |
| 6,557,271 | B1 | 5/2003 | Weaver, III |
| 6,578,288 | B2 | 6/2003 | Bernstein |
| 6,594,921 | B2 | 7/2003 | Laio et al. |
| 6,643,954 | B2 | 11/2003 | Voswinkel |
| 6,684,533 | B1 | 2/2004 | Su |
| 6,718,658 | B2 | 4/2004 | Karasawa |
| 6,817,116 | B2 | 11/2004 | Chil et al. |
| 6,876,947 | B1 | 4/2005 | Darley et al. |
| 6,882,955 | B1 | 4/2005 | Ohlenbusch et al. |
| 6,883,254 | B2 | 4/2005 | Miller et al. |
| 6,925,732 | B1 | 8/2005 | Clarke |
| 6,938,361 | B2 | 9/2005 | Su |
| 6,957,504 | B2 | 10/2005 | Morris |
| 6,964,119 | B2 | 11/2005 | Weaver, III |
| 6,978,684 | B2 | 12/2005 | Nurse |
| 7,055,268 | B2 | 6/2006 | Ha |
| 7,059,069 | B2 | 6/2006 | Raluy et al. |
| 7,080,468 | B2 | 7/2006 | Miller et al. |
| 7,101,604 | B1 | 9/2006 | Minges |
| 7,103,994 | B2 | 9/2006 | Johnson |
| 7,127,837 | B2 | 10/2006 | Ito |
| 7,168,188 | B2 * | 1/2007 | Auger ..... A43B 23/088 36/58.5 |
| 7,168,190 | B1 | 1/2007 | Gillespie |
| 7,178,270 | B2 | 2/2007 | Hurd et al. |
| 7,188,438 | B1 | 3/2007 | Bowen |
| 7,225,563 | B2 | 6/2007 | Chen et al. |
| 7,284,341 | B2 | 10/2007 | Moseley |
| 7,287,294 | B2 | 10/2007 | Miller et al. |
| 7,439,837 | B2 | 10/2008 | McDonald |
| 7,448,148 | B2 | 11/2008 | Martinez et al. |
| 7,472,495 | B2 | 1/2009 | Milbourn |
| 7,526,881 | B2 | 5/2009 | Jones et al. |
| 7,581,337 | B2 | 9/2009 | Miller et al. |
| 7,607,242 | B2 | 10/2009 | Karandonis et al. |
| 7,685,747 | B1 | 3/2010 | Gasparovic et al. |
| 7,694,435 | B1 | 4/2010 | Kiser et al. |
| 7,735,244 | B1 | 6/2010 | Ameche |
| 7,793,438 | B1 | 9/2010 | Busse et al. |
| 7,823,299 | B1 | 11/2010 | Brigham |
| 7,900,377 | B1 | 3/2011 | Perenich |
| 7,905,033 | B1 | 3/2011 | Perenich |
| 7,913,422 | B1 | 3/2011 | Perenich |
| 7,950,166 | B1 | 5/2011 | Perenich |
| 7,975,403 | B2 | 7/2011 | Mosher |
| 7,984,571 | B2 | 7/2011 | Pellegrini |
| 8,006,410 | B2 | 8/2011 | Romboli et al. |
| 8,020,317 | B1 | 9/2011 | Sokolowski |
| D648,512 | S | 11/2011 | Schlageter et al. |
| 8,065,819 | B2 | 11/2011 | Kaufman |
| 8,161,669 | B2 | 4/2012 | Keating |
| 8,171,657 | B1 | 5/2012 | Perenich |
| 8,215,030 | B2 | 7/2012 | Bowen et al. |
| 8,225,534 | B2 | 7/2012 | Mueller et al. |
| 8,225,535 | B2 | 7/2012 | Dillenbeck |
| 8,245,418 | B2 | 8/2012 | Paintin et al. |
| 8,245,421 | B2 | 8/2012 | Baudouin et al. |
| 8,256,146 | B2 | 9/2012 | Loverin |
| 8,365,443 | B2 | 2/2013 | Huynh |
| D680,719 | S | 4/2013 | Dardinski |
| 8,468,721 | B2 | 6/2013 | Sokolowski |
| 8,468,723 | B2 | 6/2013 | Malka-Harari |
| 8,499,474 | B2 | 8/2013 | Kaufman |
| 8,539,698 | B1 | 9/2013 | Woodruff |
| 8,549,774 | B2 | 10/2013 | Meschter et al. |
| 8,627,582 | B2 | 1/2014 | Perenich |
| 8,627,583 | B2 | 1/2014 | Perenich |
| 8,635,791 | B2 | 1/2014 | Baudouin et al. |
| 8,656,613 | B2 | 2/2014 | Stockbridge et al. |
| 8,677,656 | B2 | 3/2014 | Nishiwaki et al. |
| 8,745,893 | B2 | 6/2014 | Gavrieli et al. |
| 8,763,275 | B2 | 7/2014 | Shalom et al. |
| 8,769,845 | B2 | 7/2014 | Lin |

(56) References Cited

U.S. PATENT DOCUMENTS 8,834,770 B2 9/2014 Nakano
8,919,015 B2 12/2014 Holt et al.
8,991,071 B2 * 3/2015 Bathum ..... A43B 1/0027 36/11.5
9,015,962 B2 4/2015 Boudreau et al.
9,032,646 B2 5/2015 Perenich
9,044,063 B2 6/2015 Loverin et al.
9,061,096 B2 6/2015 Taylor et al.
9,089,184 B1 7/2015 Kiser et al.
9,095,188 B2 8/2015 Cavaliere
9,119,436 B1 9/2015 Ardell et al.
9,119,437 B2 9/2015 Weller et al.
9,144,262 B2 9/2015 Ardell et al.
9,173,451 B2 11/2015 Shim
9,226,543 B2 1/2016 Campbell
9,254,018 B2 2/2016 Bliss
9,265,305 B2 2/2016 Hatfield et al.
9,301,570 B2 4/2016 Hwang
9,314,055 B2 4/2016 Moran
9,314,067 B2 4/2016 Bock
9,363,980 B2 6/2016 Lander
9,392,843 B2 7/2016 Callahan et al.
9,392,844 B1 7/2016 Burrell
9,398,785 B2 7/2016 Horacek
9,398,786 B2 7/2016 Gavrieli et al.
9,414,640 B2 8/2016 Nichols
9,433,256 B2 9/2016 Callahan et al.
9,445,644 B2 9/2016 Cressman et al.
9,474,330 B2 10/2016 Panian et al.
9,480,299 B2 11/2016 Dinndorf et al.
D776,420 S 1/2017 Petrie
9,675,132 B2 6/2017 Marshall
9,788,596 B2 10/2017 Schenone
9,820,527 B2 11/2017 Pratt et al.
9,839,261 B2 12/2017 Hatfield et al.
9,854,875 B2 1/2018 Hatfield et al.
9,877,542 B2 1/2018 Pratt
9,908,027 B2 3/2018 Beers
9,949,533 B2 4/2018 Feinstein
10,045,588 B2 8/2018 Berend et al.
10,055,948 B2 8/2018 Kim
10,137,011 B2 11/2018 Herr et al.
10,159,310 B2 12/2018 Sullivan
10,426,637 B2 10/2019 Tong et al.
10,568,381 B2 2/2020 Walker
10,602,802 B2 3/2020 Hopkins et al.
10,660,401 B1 5/2020 Pratt et al.
10,779,607 B1 9/2020 Chandel
10,918,160 B2 * 2/2021 Hopkins ..... A43C 1/00
11,000,091 B1 5/2021 Kyle
11,185,125 B2 11/2021 Blanche et al.
11,308,184 B2 4/2022 Andon et al.
11,445,781 B2 * 9/2022 Hopkins ..... A43C 1/00
11,475,449 B2 10/2022 Andon et al.
11,513,610 B2 11/2022 Goel et al.
11,553,754 B2 1/2023 Andon et al.
11,666,115 B2 * 6/2023 Blanche ..... A43B 13/37 36/102
12,004,588 B2 * 6/2024 Blanche ..... A43B 13/37
12,011,058 B2 * 6/2024 Hopkins ..... A43B 13/141
12,059,052 B2 * 8/2024 Dean ..... A43B 13/16
2002/0144434 A1 10/2002 Farys et al.
2002/0174568 A1 11/2002 Neiley
2003/0009913 A1 1/2003 Potter et al.
2003/0200680 A1 10/2003 Chang
2004/0111921 A1 6/2004 Lenormand
2004/0177531 A1 9/2004 DiBenedetto et al.
2005/0039348 A1 2/2005 Raluy et al.
2005/0060913 A1 3/2005 Chil et al.
2005/0066548 A1 3/2005 Chil et al.
2005/0081404 A1 4/2005 Hurd et al.
2007/0011917 A1 1/2007 Hayes
2007/0039208 A1 2/2007 Bove et al.
2007/0074425 A1 4/2007 Leong
2007/0186441 A1 8/2007 Chen
2007/0199211 A1 8/2007 Campbell
2007/0199213 A1 8/2007 Campbell et al.
2007/0209234 A1 9/2007 Chou
2008/0000106 A1 1/2008 Culpepper
2008/0086911 A1 4/2008 Labbe
2008/0141562 A1 6/2008 Peveto
2008/0168683 A1 7/2008 Keating
2008/0263896 A1 10/2008 Karandonis et al.
2008/0307673 A1 12/2008 Johnson
2009/0025260 A1 1/2009 Nakano
2010/0063778 A1 3/2010 Schrock et al.
2010/0063779 A1 3/2010 Schrock et al.
2010/0251572 A1 10/2010 Baudouin et al.
2010/0319216 A1 12/2010 Grenzke et al.
2011/0016751 A1 1/2011 Somerville
2011/0146106 A1 6/2011 Kaufman
2011/0185592 A1 8/2011 Nishiwaki et al.
2011/0232130 A1 9/2011 Boudreau et al.
2011/0247238 A1 10/2011 Chestnut
2012/0079746 A1 4/2012 Ferreira et al.
2012/0204450 A1 8/2012 Girbaud
2012/0317839 A1 12/2012 Pratt
2013/0185959 A1 7/2013 Coleman
2013/0213147 A1 8/2013 Rice et al.
2013/0219747 A1 8/2013 Lederer
2014/0000131 A1 1/2014 Meschter et al.
2014/0013624 A1 1/2014 Stockbridge et al.
2014/0096415 A1 4/2014 Long
2014/0115925 A1 5/2014 Hurd et al.
2014/0250723 A1 9/2014 Kohatsu
2014/0259771 A1 9/2014 Dananberg et al.
2014/0298687 A1 10/2014 Flinterman et al.
2014/0305005 A1 10/2014 Yeh
2014/0310992 A1 10/2014 Shalom et al.
2014/0360049 A1 12/2014 Panian et al.
2015/0020416 A1 1/2015 Wiens
2015/0047223 A1 2/2015 Flinterman et al.
2015/0047227 A1 2/2015 Fallon et al.
2015/0096197 A1 4/2015 Salinas
2015/0113834 A1 4/2015 Dojan et al.
2015/0143720 A1 5/2015 Avar
2015/0196095 A1 7/2015 Chapman
2015/0216252 A1 8/2015 Wiens
2015/0265425 A1 9/2015 Aagaah et al.
2015/0289595 A1 10/2015 Rushbrook et al.
2015/0305432 A1 10/2015 Wiens
2015/0305442 A1 10/2015 Ravindran
2015/0374065 A1 12/2015 DiFrancisco
2016/0128429 A1 5/2016 Hatfield et al.
2016/0166006 A1 6/2016 DiFrancisco
2016/0242493 A1 8/2016 Stillwagon
2016/0374427 A1 12/2016 Zahabian
2017/0042290 A1 2/2017 Hatfield et al.
2017/0049190 A1 2/2017 Maussen
2017/0099906 A1 4/2017 Figueroa
2017/0360143 A1 12/2017 Pratt et al.
2018/0110287 A1 4/2018 Hopkins et al.
2018/0110288 A1 4/2018 Hatfield et al.
2018/0110289 A1 4/2018 Owings et al.
2018/0110292 A1 4/2018 Beers et al.
2018/0110295 A1 4/2018 Dyer et al.
2018/0153254 A1 6/2018 Fusco et al.
2018/0153264 A1 6/2018 Amos et al.
2018/0206588 A1 7/2018 Pratt et al.
2018/0213882 A1 8/2018 Morse
2018/0213890 A1 8/2018 Innocente
2018/0235314 A1 8/2018 Farage
2018/0263332 A1 9/2018 Bruno
2018/0295942 A1 10/2018 Drake
2019/0000180 A1 1/2019 Moriyasu et al.
2019/0254381 A1 8/2019 Hopkins et al.
2019/0365014 A1 12/2019 Andon
2020/0187589 A1 6/2020 Hopkins et al.
2020/0187590 A1 6/2020 Hopkins et al.
2020/0205512 A1 7/2020 Blanche et al.
2020/0368579 A1 11/2020 Cusey et al.
2020/0375269 A1 12/2020 Andon et al.
2021/0197021 A1 7/2021 Giedwoyn et al.
2021/0368925 A1 12/2021 Schneider

(56) References Cited

U.S. PATENT DOCUMENTS

| | | | |
|---|---|---|---|
| 2021/0369537 | A1 | 12/2021 | Witte et al. |
| 2022/0039512 | A1 | 2/2022 | Blanche et al. |
| 2022/0193490 | A1 | 6/2022 | Ghiotto et al. |
| 2022/0202104 | A1 | 6/2022 | Walker et al. |
| 2022/0202121 | A1 | 6/2022 | Walker et al. |
| 2022/0218551 | A1 | 7/2022 | Ding et al. |
| 2022/0241131 | A1 | 8/2022 | Papania-Davis et al. |
| 2022/0287407 | A1 | 9/2022 | Cheney et al. |
| 2022/0362094 | A1 | 11/2022 | De Rossi et al. |
| 2022/0369757 | A1 | 11/2022 | Hopkins et al. |
| 2023/0124653 | A1 | 4/2023 | Farina et al. |
| 2023/0138485 | A1 | 5/2023 | Ryabinin et al. |
| 2023/0301396 | A1 | 9/2023 | Blanche et al. |
| 2023/0342767 | A1 | 10/2023 | Andon et al. |
| 2023/0389649 | A1* | 12/2023 | Poëll ..... A43B 13/141 |
| 2024/0324718 | A1* | 10/2024 | Hopkins ..... A43B 3/248 |

FOREIGN PATENT DOCUMENTS

| | | | |
|---|---|---|---|
| CN | 87103983 | A | 12/1988 |
| CN | 2052208 | U | 2/1990 |
| CN | 2112959 | | 8/1992 |
| CN | 2161101 | Y | 4/1994 |
| CN | 2262929 | Y | 9/1997 |
| CN | 2268406 | Y | 11/1997 |
| CN | 2275814 | Y | 3/1998 |
| CN | 2281094 | Y | 5/1998 |
| CN | 2384464 | Y | 6/2000 |
| CN | 2438353 | Y | 7/2001 |
| CN | 2456500 | Y | 10/2001 |
| CN | 2482829 | Y | 3/2002 |
| CN | 1403041 | A | 3/2003 |
| CN | 2559235 | Y | 7/2003 |
| CN | 1565297 | A | 1/2005 |
| CN | 2712118 | Y | 7/2005 |
| CN | 1720835 | A | 1/2006 |
| CN | 2783792 | Y | 5/2006 |
| CN | 2819852 | Y | 9/2006 |
| CN | 1278639 | C | 10/2006 |
| CN | 1943463 | A | 4/2007 |
| CN | 2901950 | Y | 5/2007 |
| CN | 201005111 | Y | 1/2008 |
| CN | 201157014 | Y | 12/2008 |
| CN | 201167619 | Y | 12/2008 |
| CN | 101485505 | A | 7/2009 |
| CN | 101518380 | A | 9/2009 |
| CN | 201426430 | Y | 3/2010 |
| CN | 201504620 | U | 6/2010 |
| CN | 101500446 | B | 1/2011 |
| CN | 201743039 | U | 2/2011 |
| CN | 101986920 | A | 3/2011 |
| CN | 201831038 | U | 5/2011 |
| CN | 102159288 | A | 8/2011 |
| CN | 201967803 | U | 9/2011 |
| CN | 102256673 | A | 11/2011 |
| CN | 202211219 | U | 5/2012 |
| CN | 101991227 | B | 8/2012 |
| CN | 202819794 | U | 3/2013 |
| CN | 203121188 | U | 8/2013 |
| CN | 203137220 | U | 8/2013 |
| CN | 203841187 | U | 9/2014 |
| CN | 203884822 | U | 10/2014 |
| CN | 203913577 | U | 11/2014 |
| CN | 204070772 | U | 1/2015 |
| CN | 104394729 | A | 3/2015 |
| CN | 102595952 | B | 4/2015 |
| CN | 205040743 | U | 2/2016 |
| CN | 105876979 | A | 8/2016 |
| CN | 205512619 | U | 8/2016 |
| CN | 205568021 | U | 9/2016 |
| CN | 205658453 | U | 10/2016 |
| CN | 205671573 | U | 11/2016 |
| CN | 205795015 | U | 12/2016 |
| CN | 206025369 | U | 3/2017 |
| CN | 107692396 | A | 2/2018 |
| CN | 107921318 | A | 4/2018 |
| CN | 207544444 | U | 6/2018 |
| CN | 207949063 | | 10/2018 |
| DE | 3310988 | A1 | 9/1984 |
| DE | 19534249 | A1 | 3/1997 |
| DE | 19611797 | A1 | 10/1997 |
| DE | 29809404 | U1 | 8/1998 |
| DE | 29723911 | U1 | 5/1999 |
| DE | 10247163 | A1 | 4/2004 |
| DE | 102004005288 | A1 | 8/2005 |
| DE | 102009023689 | A1 | 12/2010 |
| DE | 102013200701 | A1 | 7/2013 |
| DE | 202016001813 | U1 | 6/2017 |
| EP | 0570621 | A1 | 11/1993 |
| EP | 0548116 | B1 | 12/1994 |
| EP | 1059044 | A1 | 12/2000 |
| EP | 1440627 | A1 | 7/2004 |
| EP | 1593315 | B1 | 5/2008 |
| EP | 1952715 | A1 | 8/2008 |
| EP | 2173208 | B1 | 12/2010 |
| EP | 2277402 | A2 | 1/2011 |
| EP | 2490565 | A1 | 8/2012 |
| EP | 2036449 | B1 | 4/2013 |
| EP | 2818068 | A1 | 12/2014 |
| EP | 2848141 | A1 | 3/2015 |
| EP | 2937007 | A1 | 10/2015 |
| FR | 2994800 | A1 | 3/2014 |
| FR | 3104004 | A1 | 6/2021 |
| GB | 1154145 | A | 6/1969 |
| GB | 1358470 | A | 7/1974 |
| GB | 2517399 | A | 2/2015 |
| GB | 2533809 | A | 7/2016 |
| JP | H0181910 | U | 6/1989 |
| JP | 2001149394 | A | 6/2001 |
| JP | 2004236860 | A | 8/2004 |
| JP | 2006055571 | A | 3/2006 |
| JP | 2007152066 | A | 6/2007 |
| JP | 2008206629 | A | 9/2008 |
| JP | 2014176633 | A | 9/2014 |
| KR | 20090130804 | A | 12/2009 |
| KR | 20130119566 | A | 11/2013 |
| KR | 101841085 | B1 | 3/2018 |
| KR | 101845063 | B1 | 4/2018 |
| NL | 1020208 | C1 | 9/2003 |
| TW | 585748 | B | 5/2004 |
| TW | M275736 | U | 9/2005 |
| TW | 200930315 | A | 7/2009 |
| TW | 201130440 | A | 9/2011 |
| TW | M449484 | U | 4/2013 |
| TW | M469778 | U | 1/2014 |
| TW | I581730 | B | 5/2017 |
| WO | 8808678 | A1 | 11/1988 |
| WO | 9737556 | A1 | 10/1997 |
| WO | 0076337 | A1 | 12/2000 |
| WO | 03039283 | A1 | 5/2003 |
| WO | 2005070246 | A2 | 8/2005 |
| WO | 2006084185 | A1 | 8/2006 |
| WO | 2006138170 | A1 | 12/2006 |
| WO | 2007024875 | A2 | 3/2007 |
| WO | 2007080205 | A1 | 7/2007 |
| WO | 2008115743 | A1 | 9/2008 |
| WO | 2008152414 | A1 | 12/2008 |
| WO | 2009154350 | A1 | 12/2009 |
| WO | 2010048203 | A1 | 4/2010 |
| WO | 2010059716 | A2 | 5/2010 |
| WO | 2010114993 | A1 | 10/2010 |
| WO | 2011004946 | A1 | 1/2011 |
| WO | 2011140584 | A1 | 11/2011 |
| WO | 2012044974 | A1 | 4/2012 |
| WO | 2012168956 | A1 | 12/2012 |
| WO | 2013039385 | A1 | 3/2013 |
| WO | 2013187288 | A1 | 12/2013 |
| WO | 2014033396 | A1 | 3/2014 |
| WO | 2014038937 | A1 | 3/2014 |
| WO | 2014109799 | A1 | 7/2014 |
| WO | 2014140443 | A1 | 9/2014 |
| WO | 2015002521 | A1 | 1/2015 |
| WO | 2015198460 | A1 | 12/2015 |
| WO | 2016005696 | A1 | 1/2016 |

(56) References Cited

FOREIGN PATENT DOCUMENTS

| | | | |
|---|---|---|---|
| WO | 2018092023 | A1 | 5/2018 |
| WO | 2018193276 | A1 | 10/2018 |
| WO | 2018217423 | A1 | 11/2018 |
| WO | 2021076440 | A1 | 4/2021 |

OTHER PUBLICATIONS

KIZIK Design, KIZIK® Shoes Launch Footwear Revolution with Patented Handsfree Technology, https://www.prnewswire.com/news-releases/kizik-shoes-launch-footwear-revolution-with-patented-handsfree-technology-300594838.html, Feb. 7, 2018.

Nike Ease Challenge Winner Announced, Nike News, Apr. 25, 2017, https://news.nike.com/news/nike-ease-challenge-winner-announced (accessed May 2, 2018).

* cited by examiner

FOOTWEAR WITH JOINTED SOLE STRUCTURE FOR EASE OF ACCESS

CROSS-REFERENCE TO RELATED APPLICATIONS

This application claims the benefit of priority to U.S. Provisional Application No. 63/428,370 filed Nov. 28, 2022, which is hereby incorporated by reference in its entirety.

TECHNICAL FIELD

The present disclosure generally relates to an article of footwear, and more specifically to an article of footwear with a jointed sole structure for ease of access.

BACKGROUND

Traditionally, placing footwear on a foot often requires the use of one or both hands to stretch the ankle opening of a footwear upper and hold the rear portion during foot insertion. The fit of the upper is then adjusted following foot insertion, such as by tying laces.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
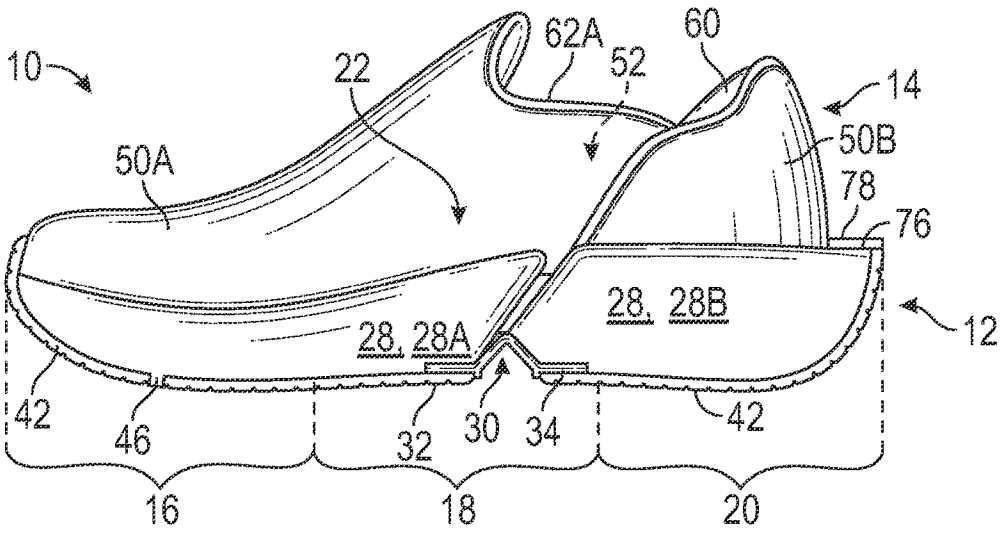
FIG. 1 is a medial side view of an article of footwear with a sole structure in a use position.

An article of footwear disclosed herein may enable hands-free placement of the article of footwear on a foot by providing a sole structure with separate front and rear midsole components that define a groove at a lower side of the sole structure with a hinge disposed in the groove and connecting the midsole components. The hinge enables the sole structure to pivot (e.g., articulate) at the groove between a first orientation, referred to as a use position in which the groove is relatively open, and a second orientation, referred to as an access position in which the groove is relatively closed.

In some examples, separate front and rear upper portions may be secured to the front and rear midsole components. At least parts of the front and rear upper portions may be further apart from one another in the access position than in the use position, allowing easier foot entry into the front upper portion, and with the rear upper portion then automatically closing around the foot as the footwear returns to the use position under a load of the foot.

In some implementations, the article of footwear may be characterized by the absence of a biasing member extending between and connecting the front midsole component and the rear midsole component, or extending between and connecting the front upper portion and the rear upper portion, or extending between and connecting the front upper portion and the rear midsole component, or extending between and connecting the front midsole component and the rear upper portion, and configured to maintain the sole structure in the access position and/or in the use position.

Instead, for example, the outsole may be characterized by at least a predetermined coefficient of friction (e.g., a static coefficient of friction and/or a sliding coefficient of friction of at least a predetermined magnitude) to maintain the sole structure in the access position until loaded by a foot to move to the use position. For example, the material and configuration of the outsole alone may provide at least the predetermined coefficient of friction to maintain the sole structure in the access position until loaded by a foot to move to the use position without any of an elastic band(s), biasing plate(s), or other component(s) included primarily to provide a biasing force that urges the sole structure toward the access position and/or the use position.

In addition, in some examples, the front midsole component may include a heel footbed that extends over the groove and overlays the rear midsole component in the use position. The article of footwear may include a divided footwear upper with a front upper portion secured to the front midsole component and a separate rear upper portion secured to the rear midsole component. The rear upper portion may include at least a portion of a heel collar, and the heel collar may be configured to support the heel footbed in the access position and resiliently deform to permit the heel footbed to move past the heel collar to the use position.

In an example, a resilient band may be suspended over and extend transversely across a portion of the inner surface of the rear midsole component (e.g., the top surface, also referred to as the foot support surface). For example, the resilient band may be secured to the inner surface at the medial and lateral side walls of the rear midsole component. In the access position, the resilient band may be spaced apart from portion of the inner surface of the rear midsole component and a heel footbed may rest on the resilient band. In the use position, the resilient band may resiliently stretch under load to allow the heel footbed to rest on the inner surface of the rear midsole component.

In an aspect, a side of the heel footbed and an inner surface of the rear midsole component may include complementary interlocking features that secure the heel footbed in the use position. In some examples, a tab may protrude at a side periphery of the heel footbed, and the rear midsole component may at least partially define a recess at an inner surface of the rear midsole component in which the tab is disposed to secure the heel footbed in the use position until a removal force is applied to the sole structure as discussed herein. The medial side of the heel footbed, the lateral side of the heel footbed, or both, may include such a tab. In other examples, the side periphery of the heel footbed may include a recess and the rear midsole component may include a tab protruding at the inner surface of the rear midsole component that is disposed in the recess of the heel footbed to secure the heel footbed in the use position until a removal force is applied to the sole structure as discussed herein.

In an example, the sole structure may comprise a stiffening layer secured to the side periphery of the heel footbed and the medial-side tab and the lateral-side tab may be integral with the stiffening layer.

In another example, a peripheral support may be secured to the rear midsole component, such as at the inner side walls at the inner surface of the rear midsole component and may have an edge disposed adjacent to the recess in the rear midsole component. The wall support may be stiffer than the rear midsole component and the tab may be disposed in the recess under the edge of the wall support when the sole structure is in the use position to secure the heel footbed in the use position. In this manner, the more rigid wall support helps to maintain the tab in the recess.

The hands-free operation of the article of footwear may be made possible by these and/or other aspects described herein.

The above features and advantages and other features and advantages of the present teachings are readily apparent from the following detailed description of the modes for carrying out the present teachings when taken in connection with the accompanying drawings. It should be understood that even though embodiments may be separately described in the following Figures, single features thereof may be combined in additional embodiments.

Figure 3:
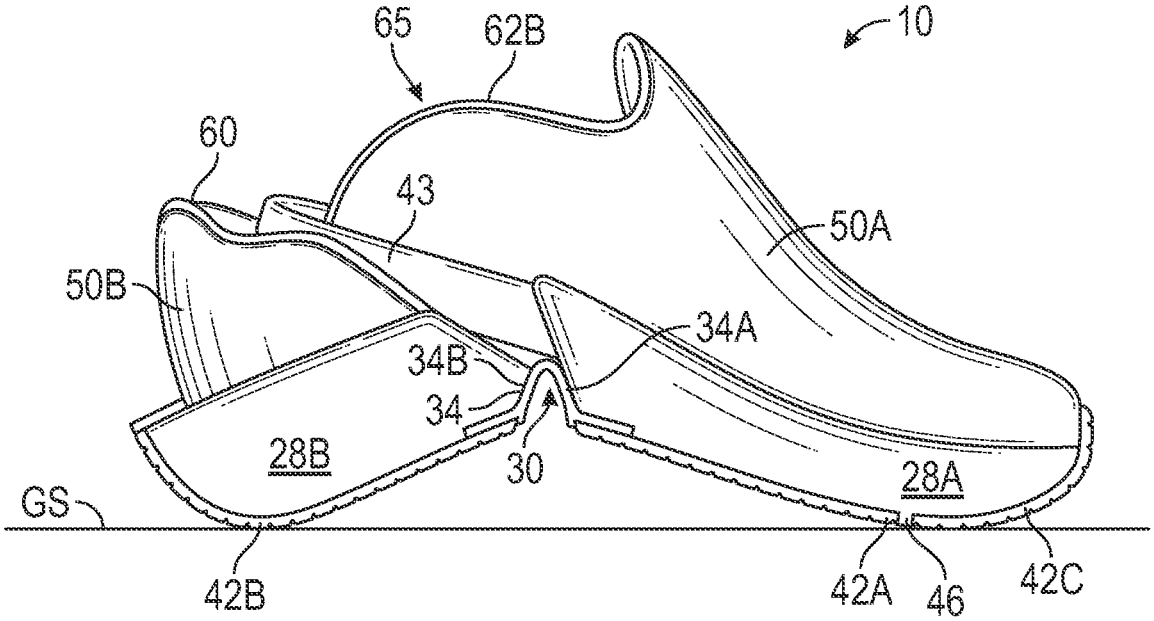
FIG. 3 is a lateral side view of the article of footwear of FIG. 1 in an access position.

Referring to the drawings, wherein like reference numbers refer to like components throughout the views, FIG. 1 shows an example of an article of footwear 10 (also referred to herein simply as footwear 10) that includes a sole structure 12 and a footwear upper 14 (also referred to herein as an upper). As discussed herein, these and other features of the article of footwear 10 enable an access position of the article of footwear 10 (such as shown in FIG. 3) that particularly affords easy, hands-free foot entry into the article of footwear 10. Additionally, the article of footwear 10 adopts a use position (such as shown in FIG. 1) after foot entry, particularly also in a hands-free manner. The article of footwear 10 herein is depicted as a leisure shoe or an athletic shoe, but the present teachings are not limited to such, and also encompass dress shoes, work shoes, sandals, slippers, boots, or any other category of footwear.

The article of footwear 10 has three general regions: a forefoot region 16, a midfoot region 18, and a heel region 20, which are also the forefoot region, the midfoot region, and the heel region, respectively, of the sole structure 12 and the footwear upper 14. The footwear 10 also includes a medial side 22 and a lateral side 24 (best shown in FIG. 2) opposite from the medial side 22.

The forefoot region 16 generally includes portions of the article of footwear 10 corresponding with the toes and the joints connecting the metatarsals with the phalanges of a wearer's foot. The midfoot region 18 generally includes portions of the article of footwear 10 corresponding with the arch area of the foot, and the heel region 20 corresponds with rear portions of the foot, including the calcaneus bone. The medial side 22 and the lateral side 24 extend through each of forefoot region 16, the midfoot region 18, and the heel region 20 and correspond with opposite sides of the article of footwear 10. The forefoot region 16, the midfoot region 18, the heel region 20, the medial side 22, and the lateral side 24 are not intended to demarcate precise areas of footwear 10 but are instead intended to represent general areas of footwear 10 to aid in the following discussion.

The sole structure 12 includes a midsole 28 that has a front midsole component 28A and a separate rear midsole component 28B. The rear midsole component 28B is separate and divided from the front midsole component 28A. Stated differently, the front midsole component 28A particularly is not integrally formed with, is not unitary with, and/or is not directly attached to the rear midsole component 28B. The front midsole component 28A and the rear midsole component 28B together define a groove 30 at a lower side 32 of the sole structure 12 between the front midsole component 28A and the rear midsole component 28B.

The footwear upper 14 may be a divided footwear upper having a front upper portion 50A and a rear upper portion 50B. The divided footwear upper 14 is secured to the sole structure 12 to define a foot-receiving cavity 52. More particularly, the front upper portion 50A is secured to the front midsole component 28A, and the separate rear upper portion 50B is secured to the rear midsole component 28B.

The footwear upper 14 is referred to as divided because the front upper portion 50A and the rear upper portion 50B are separate, discrete upper components that are not physically directly connected to one another.

A hinge 34 is disposed in the groove 30 and connects the front midsole component 28A to the rear midsole component 28B. The front midsole component 28A and the rear midsole component 28B are pivotable relative to one another at the groove 30 between a use position (shown in FIGS. 1 and 2) and an access position (shown in FIGS. 3 and 6). The groove 30 is relatively open in the use position and relatively closed in the access position.

Figure 2:
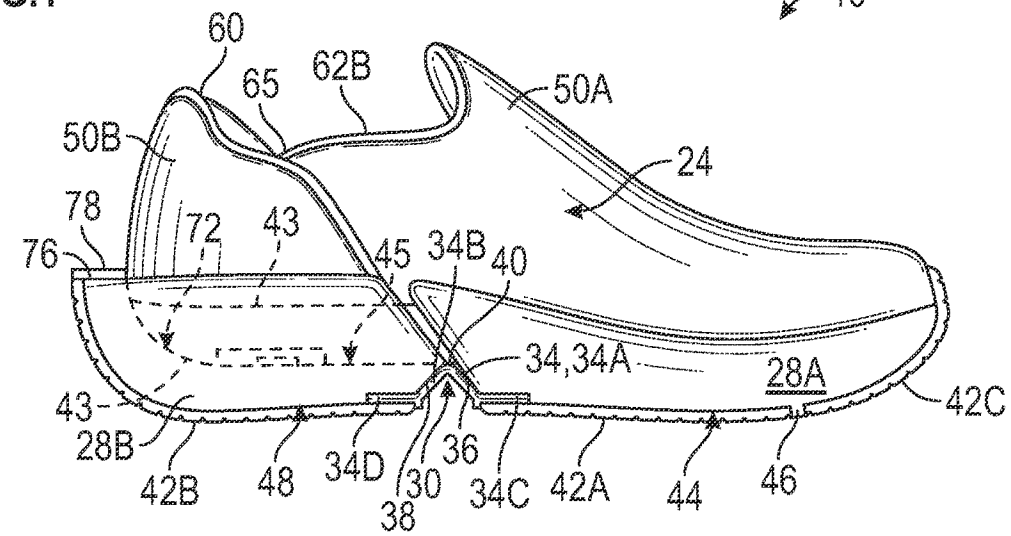
FIG. 2 is a lateral side view of the article of footwear of FIG. 1 with the sole structure in the use position.

Referring to FIG. 2, the front midsole component 28A includes a first wall 36 defining a front of the groove 30. The rear midsole component 28B includes a second wall 38 defining a rear of the groove 30. The hinge 34 has a first wall 34A that lines the first wall 36. The hinge 34 has a second wall 34B integral with the first wall 34A. The first wall 34A and the second wall 34B define a peak 40 therebetween. The second wall 34B of the hinge 34 lines the second wall 38 of the rear midsole component 28B. The hinge 34 flexes at the peak 40 when the sole structure 12 moves between the use position and the access position.

Confronting surfaces of the hinge 34 at the groove 30 (e.g., exposed surfaces or outer surfaces of the first wall 34A and the second wall 34B of the hinge 34) are closer to one another in the access position (see FIG. 3) than in the use position (see FIG. 2) so that the groove 30 is relatively open in the use position in comparison to the access position, and the groove 30 is relatively closed in the access position in comparison to the use position. Specifically, as shown in FIG. 1, the groove 30 is relatively open and/or the front upper portion 50A and the rear upper portion 50B are adjacent to one another in the use position. As shown in FIG. 3, the groove 30 is relatively closed and at least parts of the front upper portion 50A and the rear upper portion 50B are spaced further apart from one another in the access position than in the use position, widening the ankle opening 65 in comparison to the use position to ease foot entry.

Figure 5:
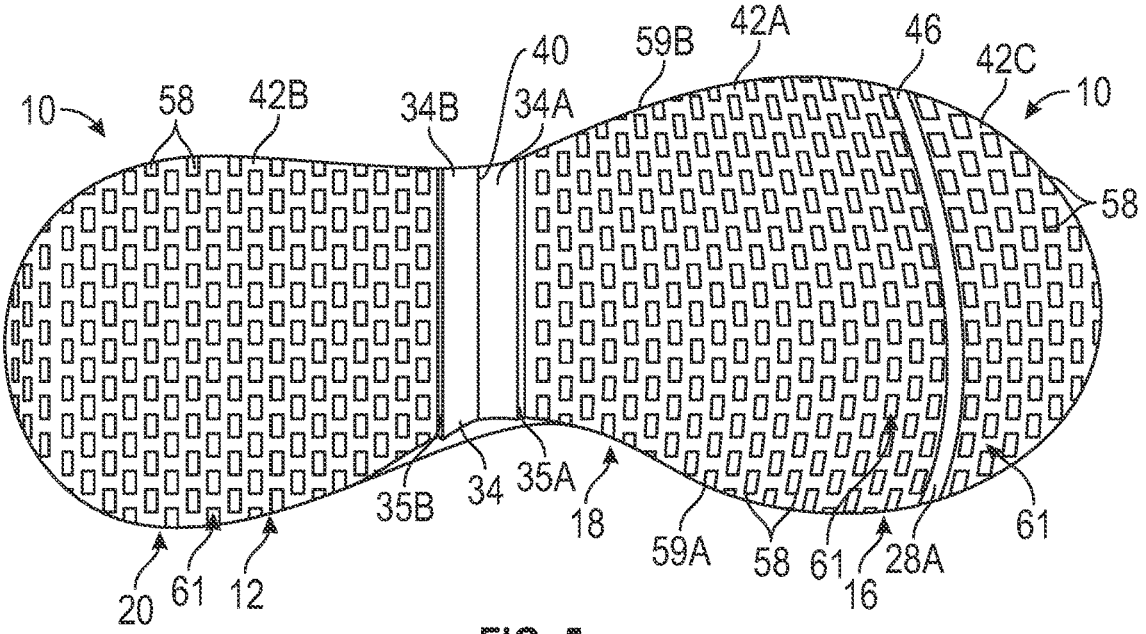
FIG. 5 is a bottom view of the article of footwear of FIG. 1 in the use position.

The sole structure 12 further includes an outsole 42. In the example shown, the outsole 42 includes three discrete components: a front outsole component 42A, a rear outsole component 42B, and a toe region outsole component 42C, as best shown in FIG. 5. The front outsole component 42A and the toe region outsole component 42C are secured to the bottom surface 44 of the front midsole component 28A (see FIG. 2). The toe region outsole component 42C is discrete and separate from the front outsole component 42A. The front midsole component 28A spans a gap 46 (see FIG. 5) between the toe region outsole component 42C and the front outsole component 42A and may extend at least partially downward into the gap 46 between the toe region outsole component 42C and the front outsole component 42A. The rear outsole component 42B is secured to a bottom surface 48 of the rear midsole component 28B and is discrete and separate from the front midsole component 28A. The front outsole component 42A is entirely forward of the groove 30 and the rear outsole component 42B is entirely rearward of the groove 30.

The hinge 34 includes a forward leg 34C integral with the first wall 34A and extending forward from the first wall 34A under the front midsole component 28A. The hinge 34 further includes a rear leg 34D integral with the second wall 34B and extending rearward from the second wall 34B under the rear midsole component 28B. The front outsole component 42A is secured to the bottom surface of the forward leg 34C of the hinge 34, and the rear outsole component 42B is secured to the bottom surface of the rear leg 34D of the hinge 34. For example, the outsole components 42A, 42B, and 42C may be secured to the respective front and rear midsole components 28A, 28B and the outsole components 42A, 42B to the respective forward and rear legs 34C, 34D with adhesive, by heat bonding, or otherwise.

In FIG. 1, the groove 30 particularly is configured as substantially having a triangular shape in a cross-section taken along a longitudinal length of the article of footwear 10. In other examples, the groove 30 may be more semi-circular, square, or rectangular in cross-section. The groove 30 may have any cross-sectional shape that allows the two midsole components 28A, 28B to pivot relative to one another at the groove 30. The peak 40 of the hinge 34 or the top of the groove 30 at a cross-section through the groove 30 particularly is configured to permit flexing of the material for opening and closing of the groove 30 while minimizing or reducing stress concentrations or fatigue. For example, if a top of the groove 30 and a peak 40 of the hinge 34 particularly extends from the lateral side 24 to the medial side 22 of the sole structure 12, then internal forces resulting from the flexing (such as forces on the hinge 34) are spread across the width of the sole structure 12, reducing stress concentrations. Additionally, if the top of the groove 30 and the peak 40 of the hinge 34 particularly have a relatively rounded rather than a relatively pointed shape (e.g., do not have a pointed apex), internal forces are spread over a greater area of the material, reducing stress concentrations in comparison to a pointed groove.

The front midsole component 28A and the rear midsole component 28B may comprise, for example, an elastomeric foam such as a polyurethane or ethylvinylacetate foam to attenuate ground reaction forces (i.e., provide cushioning) when compressed between the foot and the ground during walking, running, or other ambulatory activities. Either or both of the front midsole component 28A and the rear midsole component 28B may incorporate fluid-filled chambers, plates, moderators, or other elements that further attenuate forces, enhance stability, or influence the motions of the foot. For example, the heel footbed 43 of the front midsole component 28A discussed herein may include a first plate 198 and a second plate 199 as discussed with respect to the article of footwear 110.

In the example shown, the foam of the midsole components 28A, 28B may include a foamed polymeric material and may be at least partially a polyurethane (PU) foam, a polyurethane ethylene-vinyl acetate (EVA) foam, and may include heat-expanded and molded EVA foam pellets.

The foamed polymeric material includes one or more polymers. The one or more polymers may include an elastomer, including a thermoplastic elastomer (TPE). The one or more polymers may include aliphatic polymers, aromatic polymers, or mixture of both. In one example, the one or more polymers may include homopolymers, copolymers (including terpolymers), or mixtures of both. The copolymers may be random copolymers, block copolymers, alternating copolymers, periodic copolymers, or graft copolymers, for instance. The one or more polymers may include olefinic homopolymers or copolymers or a mixture of olefinic homopolymers and copolymers. Examples of olefinic polymers include polyethylene (PE) and polypropylene (PP). For example, the PE may be a PE homopolymer such as a low density PE or a high density PE, a low molecular weight PE or an ultra-high molecular weight PE, a linear PE or a branched chain PE, etc. The PE may be an ethylene copolymer such as, for example, an ethylene-vinyl acetate (EVA) copolymer, an ethylene-vinyl alcohol (EVOH) copolymer, an ethylene-ethyl acrylate copolymer, an ethylene-unsaturated mono-fatty acid copolymer, etc. The one or more polymers may include a polyacrylate such as a polyacrylic acid, an ester of a polyacrylic acid, a polyacrylonitrile, a polyacrylic acetate, a polymethyl acrylate, a polyethyl acrylate, a polybutyl acrylate, a polymethyl methacrylate, a polyvinyl acetate, etc., including derivatives thereof, copolymers thereof, and any mixture thereof, in one example. The one or more polymers may include an ionomeric polymer. The ionomeric polymer may be a polycarboxylic acid or a derivative of a polycarboxylic acid, for instance. The ionomeric polymer may be a sodium salt, a magnesium salt, a potassium salt, or a salt of another metallic ion. The ionomeric polymer may be a fatty acid modified ionomeric polymer. Examples of ionomeric polymers include polystyrene sulfonate, and ethylene-methacrylic acid copolymers. The one or more polymers may include a polycarbonate. The one or more polymers may include a fluoropolymer. The one or more polymers may include a polysiloxane. The one or more polymers may include a vinyl polymer such as polyvinyl chloride (PVC), polyvinyl acetate, polyvinyl alcohol, etc. The one or more polymers may include a polystyrene. The polystyrene may be a styrene copolymer such as, for example, an acrylonitrile butadiene styrene (ABS), a styrene acrylonitrile (SAN), a styrene ethylene butylene styrene (SEBS), a styrene ethylene propylene styrene (SEPS), a styrene butadiene styrene (SBS), etc. The one or more polymers may include a polyamide (PA). The PA may be a PA 6, PA 66, PA 11, or a copolymer thereof. The polyester may be an aliphatic polyester homopolymer or copolymer such as polyglycolic acid, polylactic acid, polycaprolactone, polyhydroxybutyrate, and the like. The polyester may be a semi-aromatic copolymer such as polyethylene terephthalate (PET) or polybutylene terephthalate (PBT). The one or more polymers may include a polyether such as a polyethylene glycol or polypropylene glycol, including copolymers thereof. The one or more polymers may include a polyurethane, including an aromatic polyurethane derived from an aromatic isocyanate such as diphenylmethane diisocyanate (MDI) or toluene diisocyanate (TDI), or an aliphatic polyurethane derived from an aliphatic isocyanate such as hexamethylene diisocyanate (HDI) or isophone diisocyanate (IPDI), or a mixture of both an aromatic polyurethane and an aliphatic polyurethane.

The foamed polymeric material may be a chemically foamed polymeric material, which is foamed using a chemical blowing agent that forms a gas when heated. For example, the chemical blowing agent can be an azo compound such as azodicarbonamide, sodium bicarbonate, or an isocyanate. Alternatively, or additionally, the foamed polymeric material may be a physically foamed polymeric material, which is foamed using a physical blowing agent which changes phase from a liquid or a supercritical fluid to a gas due to changes in temperature and/or pressure.

Optionally, in addition to the one or more polymers, the polymeric material may further include one or more fillers such as glass fiber, powdered glass, modified or natural silica, calcium carbonate, mica, paper, wood chips, modified or natural clays, modified or unmodified synthetic clays, talc, etc. Similarly, the polymeric material optionally may further include one or more colorants, such as pigments or dyes. Other optional components of the polymeric material include processing aids, ultra-violet light absorbers, and the like.

The foamed polymeric material may be a crosslinked foamed polymeric material, i.e., a foamed material in which covalent crosslinking bonds exist between at least a portion of the one or more polymers. A crosslinked foamed polymeric material can be formed by including a crosslinking agent in the polymeric material used to form the foam. The crosslinking agent can be a peroxide-based crosslinking agent such as dicumyl peroxide. Alternatively, the foamed polymeric material can be an uncrosslinked foamed polymeric material which has thermoplastic properties. The foamed polymeric material may be an elastomeric foamed material.

The front midsole component 28A extends in the forefoot region 16 and the midfoot region 18, and/or particularly includes a heel footbed 43 (see, e.g., FIGS. 3, 4, and 6) that extends in the heel region 20. Accordingly, the front midsole component 28A particularly is a full-length midsole component. In other examples, there may be no heel footbed 43, or there may be a footbed portion extending rearward over the groove 30 that does not extend fully to the heel region 20. The heel footbed 43 extends over the groove 30 and overlays the rear midsole component 28B in the use position and is spaced apart from the rear midsole component 28B in the access position. The heel footbed 43 overlays and contacts a portion 45 of the inner surface 72 of the rear midsole component 28B in the use position, inward of the rear upper portion 50B, as shown in phantom in FIG. 2 and discussed herein with respect to corresponding components of the article of footwear 110. The portion 45 is also referred to as the top surface and/or the foot-facing surface and/or foot support surface and/or top-facing surface of the rear midsole component 28B.

Figure 6:
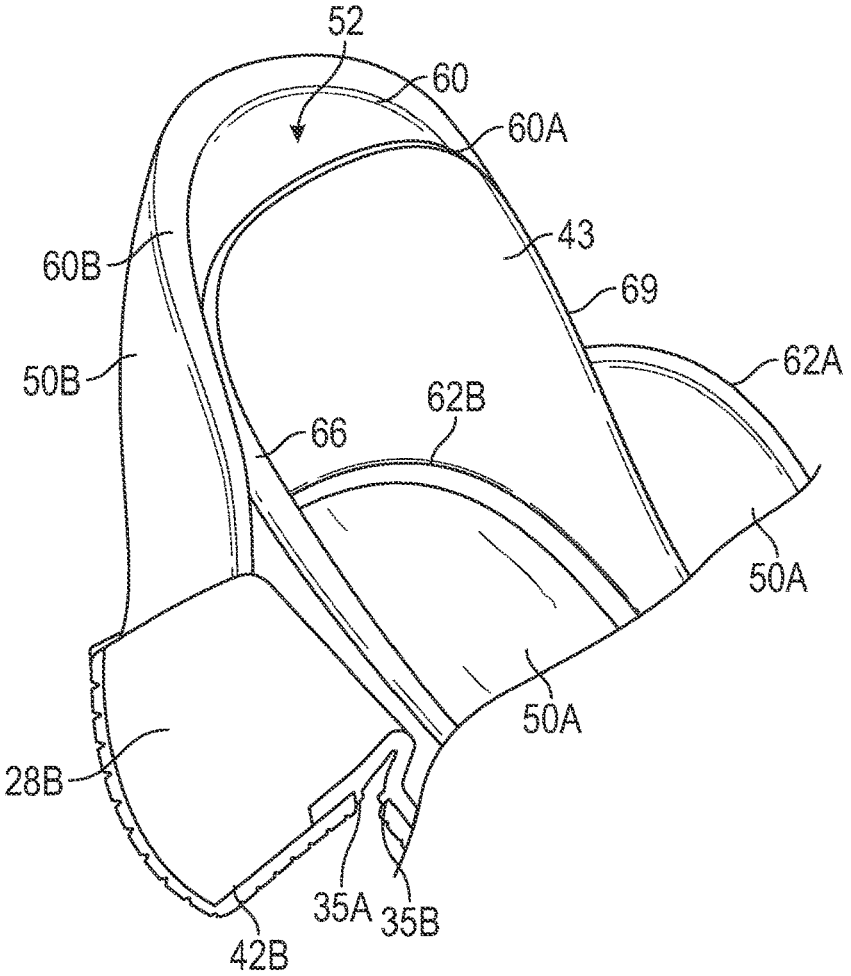
FIG. 6 is a fragmentary perspective view of the article of footwear of FIG. 1 in the access position.

As shown in FIG. 6, the heel footbed 43 extends the full width of the foot-receiving cavity 52 between the medial and lateral sides of the rear upper portion 50B discussed herein. In other examples, the heel footbed 43 need not extend the full width.

The heel footbed 43 particularly is an integral portion of the front midsole component 28A. Stated differently, the front midsole component 28A, including the heel footbed 43, may be a one-piece component, e.g., formed by injection molding or otherwise. In contrast, the rear midsole component 28B particularly is not a full-length midsole component, as it extends in the heel region 20, but does not extend in the forefoot region 16, and/or extends only slightly, if at all, in the midfoot region 18. The rear midsole component 28B particularly extends mainly rearward of the groove 30 and mainly in the heel region 20.

The article of footwear 10 is characterized by an absence of a biasing member configured to maintain the sole structure 12 in one of the use position or the access position (e.g., in a bi-stable arrangement). For example, the footwear upper 14 and the sole structure 12 are characterized by an absence of (e.g., do not include) a biasing member extending between the front upper portion 50A and the rear upper portion 50B, or between the front midsole component 28A and the rear midsole component 28B, or between the front upper portion 50A and the rear midsole component 28B, or between the rear upper portion 50B and the front midsole component 28A, etc. Accordingly, no bands, straps, biasing plates, etc. are added to the article of footwear 10 to bias the article of footwear 10 to the use position and/or the access position. Instead, the outsole 42 is characterized by at least a predetermined coefficient of friction (e.g., a predetermined coefficient of static friction and/or a predetermined coefficient of sliding friction) to maintain the sole structure 12 in the access position. Stated differently, the outsole 42 is of a material and a configuration such that contact of the outsole 42 with the ground surface GS when in the access position of FIG. 3 provides sufficient forces resisting relative movement of the outsole components 42A, 42B, and/or 42C, such as sliding of the sole structure 12 on the ground surface GS and preventing the article of footwear 10 from moving to the use position without the loading of an entering foot. Alternatively or in addition, a resilient band such as the resilient band 302 described with respect to FIGS. 23 and 25 may be used to help maintain the article of footwear 10 in the access position.

As shown in FIG. 3, a portion of the rear outsole component 42B and a portion of the front outsole component 42A and/or the toe region outsole component 42C rest on the ground surface GS in the access position. By selecting the materials of the outsole 42 to provide at least the predetermined coefficient of friction (e.g., a predetermined coefficient of static friction and/or a predetermined coefficient of sliding friction) on various selected materials of the ground surface GS, such as typical flooring surfaces, concrete, etc., according to ASTM standardized test(s), no biasing member is needed to maintain the article of footwear in the access position.

In an example, the outsole 42 may be formed from materials that may generally include natural or synthetic rubber or other suitably durable materials. The material or materials for the outsole 42 may be selected to provide a desirable combination of durability, flexibility, and at least the predetermined coefficient of friction discussed herein. Synthetic rubbers that may be used include polybutadiene rubber, ethylene propylene rubber (EPR), styrene isoprene styrene (SIS) copolymer rubber, and styrene butadiene rubber.

Referring to FIG. 5, the outsole components 42A, 42B, and 42C each include a plurality of spaced tread elements 58 only some of which are indicated reference numbers in FIG. 5. Alternatively, none of or only one or two of the outsole components 42A, 42B, and 42C may include such tread elements 58. The tread elements 58 extend from a medial side edge 59A to a lateral side edge 59B of the sole structure 12 in each of the forefoot region 16, the midfoot region 18, and the heel region 20. The tread elements 58 extend downward and define a portion of the ground engaging surface 61 of the sole structure 12. The tread elements 58 ensure sufficient contact with the ground surface GS even in the case of an uneven ground surface. Additionally, the tread elements 58 have sufficient compliance to increase friction relative to the ground surface GS in comparison to a ground engaging surface without the tread elements 58.

Optionally, interference between the rear upper portion 50B and the heel footbed 43 further enhances the ability to maintain the article of footwear 10 in the access position in the absence of loading of an entering foot. For example, in the access position of FIG. 6, the rear upper portion 50B is shown including a heel collar 60. The heel collar 60 of the rear upper portion 50B along with a medial-side front collar portion 62A and a lateral-side front collar portion 62B of the front upper portion 50A define an ankle opening 65 that is wider in the access position (see FIG. 3) than in the use position (see FIG. 2). A medial side portion 60A of the heel collar 60 and a lateral side portion 60B of the heel collar 60 are spaced sufficiently close to one another and include sufficient compliant cushioning that the medial and lateral side portions 60A, 60B of the heel collar 60 support the heel footbed 43 in the access position (in the absence of loading by an entering foot) and resiliently deform to permit the heel footbed 43 to move past the heel collar 60 to the use position under loading of an entering foot.

The rear upper portion 50B and the front upper portion 50A may include any one or more of several different materials. For example, the rear upper portion 50B and the front upper portion 50A may include leather, textiles, polymers, cotton, foam, composites, etc., or combinations of these. The rear upper portion 50B and the front upper portion 50A may be a polymeric material capable of providing elasticity, and may be of a braided construction, a knitted (e.g., warp-knitted) construction, or a woven construction.

Figure 4:
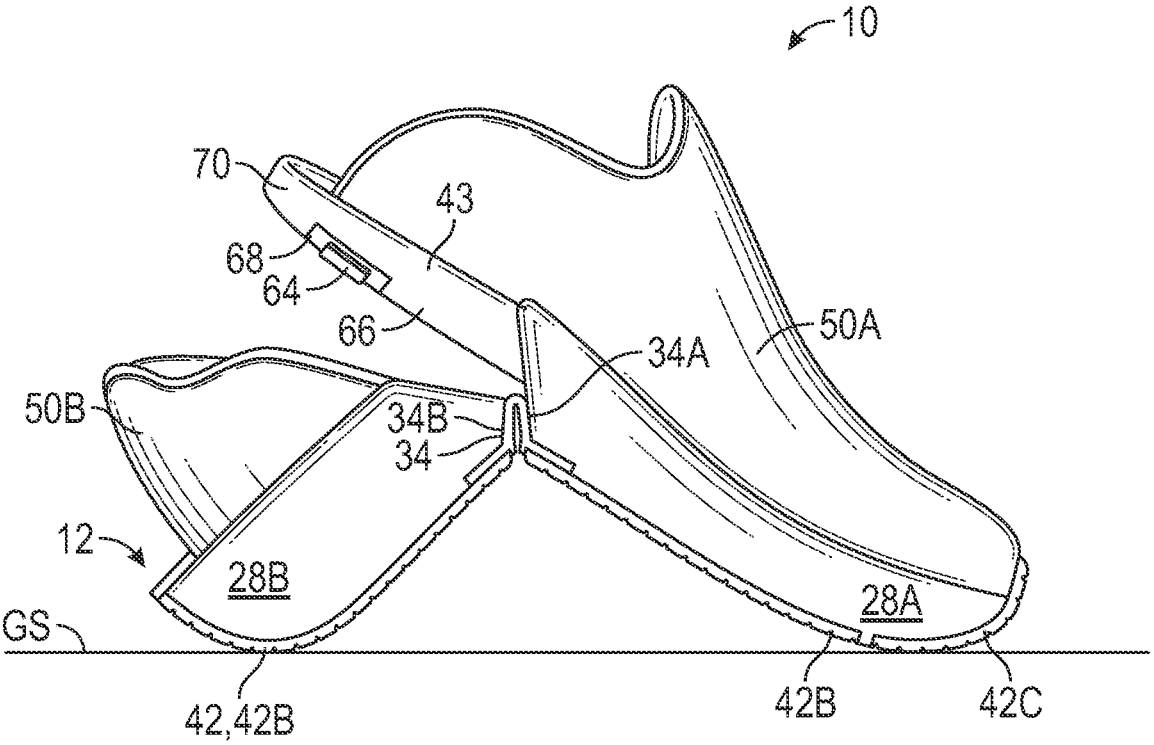
FIG. 4 is a lateral side view of the article of footwear of FIG. 1 pivoted further than the access position with a lateral-side stiffening layer and protruding lateral-side tab visible.

FIG. 4 shows the article of footwear with the sole structure 12 articulated even further than the access position of FIG. 3 (e.g., the groove 30 is further closed than in FIG. 3) exposing more of the heel footbed 43 than in the access position of FIG. 3. For example, the walls 34A, 34B of the hinge 34 will eventually touch to provide a stop (e.g., the groove 30 completely closes to prevent further rotation or pivotal movement toward one another), but the exterior surfaces of the first and second walls 34A, 34B in the groove 30 need not necessarily touch in the access position of FIG. 3.

To help maintain the article of footwear 10 in the use position, FIG. 4 shows that the sole structure 12 includes a lateral-side tab 64 protruding at a lateral-side periphery 66 of the heel footbed 43. In the example shown, the sole structure 12 includes a lateral-side stiffening layer 68 secured at the lateral-side periphery 66 of the heel footbed 43, and the lateral-side tab 64 is an integral portion of the lateral-side stiffening layer 68. The lateral-side stiffening layer 68 and the integral lateral-side tab 64 are stiffer than the heel footbed 43. Although not shown, the heel footbed 43 may include a like medial-side stiffening layer secured at the medial side periphery 69 (see FIG. 6) of the heel footbed 43 and a medial-side tab as an integral portion of the medial-side stiffening layer, as shown with respect to the article of footwear 110 in FIG. 12. In FIGS. 3 and 6, the lateral-side stiffening layer 68 and the integral lateral-side tab 64 are covered by the rear upper portion 50B in the access position.

The lateral-side stiffening layer 68 may be secured to the body 70 of the heel footbed 43 such as with adhesive, or may be coated on the body 70, or otherwise applied to define a portion of the lateral-side periphery 66 of the heel footbed 43. In one example, the lateral-side stiffening layer 68 is molded separately from the body 70 and is then adhered to the body 70. In another example, foam used to form the body 70 may be processed such as by temperature-controlled curing so that the lateral-side stiffening layer 68 is an integral external skin of the body 70 that is more dense than a remaining internal portion of the body 70 that it covers.

The body 70 may be relatively less hard than the lateral-side stiffening layer 68 and the integral lateral-side tab 64. For example, the body 70 may have a first hardness and the lateral-side stiffening layer 68 and the integral lateral-side tab 64 may have a second hardness greater than the first hardness. For example, the body 70 may be elastomeric foam, as discussed, and the lateral-side stiffening layer 68 and the integral lateral-side tab 64 may be a semi-rigid or rigid plastic (such as a thermoplastic), a composite, nylon, a polyether block amide such as PEBAX® available from Arkema, Inc. in King of Prussia, Pennsylvania USA, a fiberglass reinforced polyamide, a rigid thermoplastic polyurethane (with or without glass fiber).

Because the protruding lateral-side tab 64 is of the harder material of the lateral-side stiffening layer 68, the lateral-side tab 64 moves past softer, compressible portions of the rear upper portion 50B and the rear midsole component 28B by compressing such portions when under loading of an entering foot and then interlocks with the rear midsole component 28B in the use position. Specifically, the rear midsole component 28B includes an inner surface 72 (indicated in phantom in FIG. 2) with a lateral-side recess in a lateral side of the inner surface, as shown in greater detail with respect to the like inner surface 72 of the rear midsole component 128B of the article of footwear 110 in FIG. 12. The lateral-side tab 64 is disposed in the lateral-side recess when the sole structure 12 moves to the use position to secure the heel footbed 43 in the use position. More specifically, the lateral-side tab 64 in the lateral-side recess and/or a similar medial side tab in a medial side recess interlocks the heel footbed 43 to the rear midsole component 28B to help maintain the article of footwear 10 in the use position.

To remove the article of footwear 10 in a hands-free manner, the wearer's opposite foot may be placed on an external ledge 76 of the rear midsole component 28B. The external ledge 76 may have a reinforcing cover 78 that is a relatively hard plastic, similar to the material of the lateral-side tab 64. By depressing the external ledge 76 with the wearer's opposite foot pushing down on the cover 78, the rear midsole component 28B is urged to pivot downward and rearward with respect to the use position of FIG. 1, urging the sole structure 12 to articulate to the access position, moving the groove 30 to the relatively closed position, and providing enough force to move the lateral-side tab 64 and any corresponding medial side tab out of the lateral-side recess and any corresponding medial side recess, to release the heel footbed 43, which moves to the access position of FIG. 3 as the front midsole component 28A pivots about the groove 30 relative to the rear midsole component 28B. The frictional forces of the outsole 42 on the ground surface GS are overcome to allow such articulation.

The rear midsole component 28B may also include a forward-projecting clip (like clip 182 discussed with respect to the article of footwear 110) that overlays the rear extent of the heel footbed 43 in the use position to further help maintain the heel footbed 43 in the use position. The forward-projecting clip flexibly interfaces with the rear extent of the heel footbed 43 when the sole structure 12 moves from the use position to the access position. The clip may also be referred to as a lip.

Figure 7:
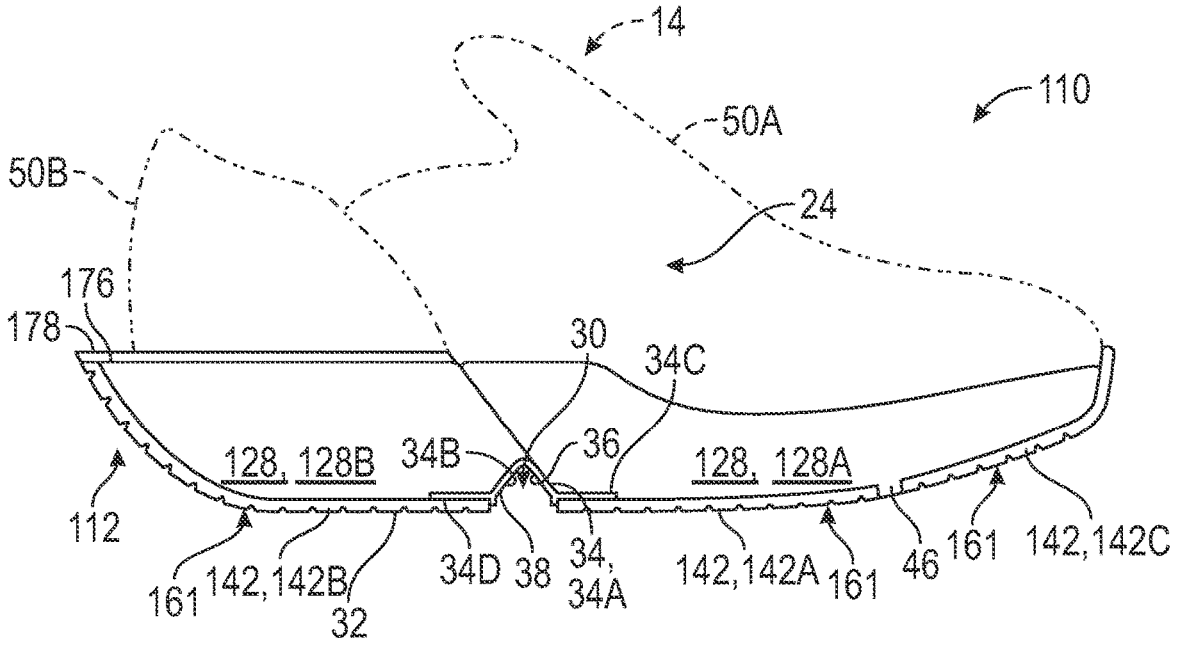
FIG. 7 is a lateral side view of an alternative example of an article of footwear in a use position and showing a footwear upper in phantom.
Figure 8:
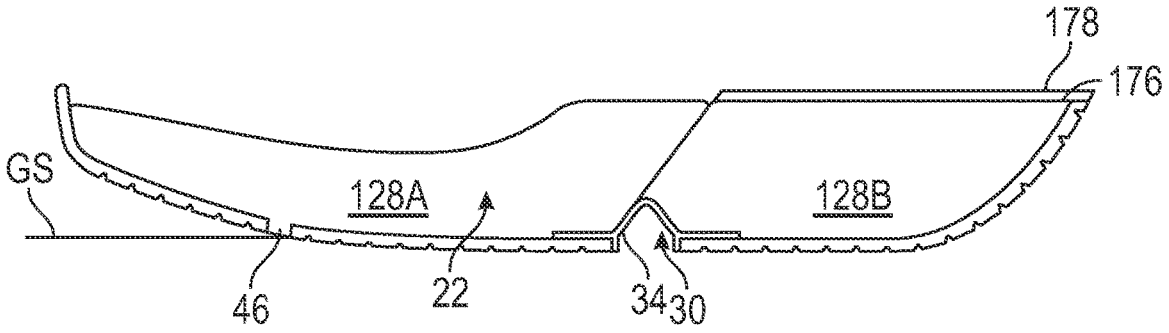
FIG. 8 is a medial side view of the sole structure of the article of footwear of FIG. 7.
Figure 10:
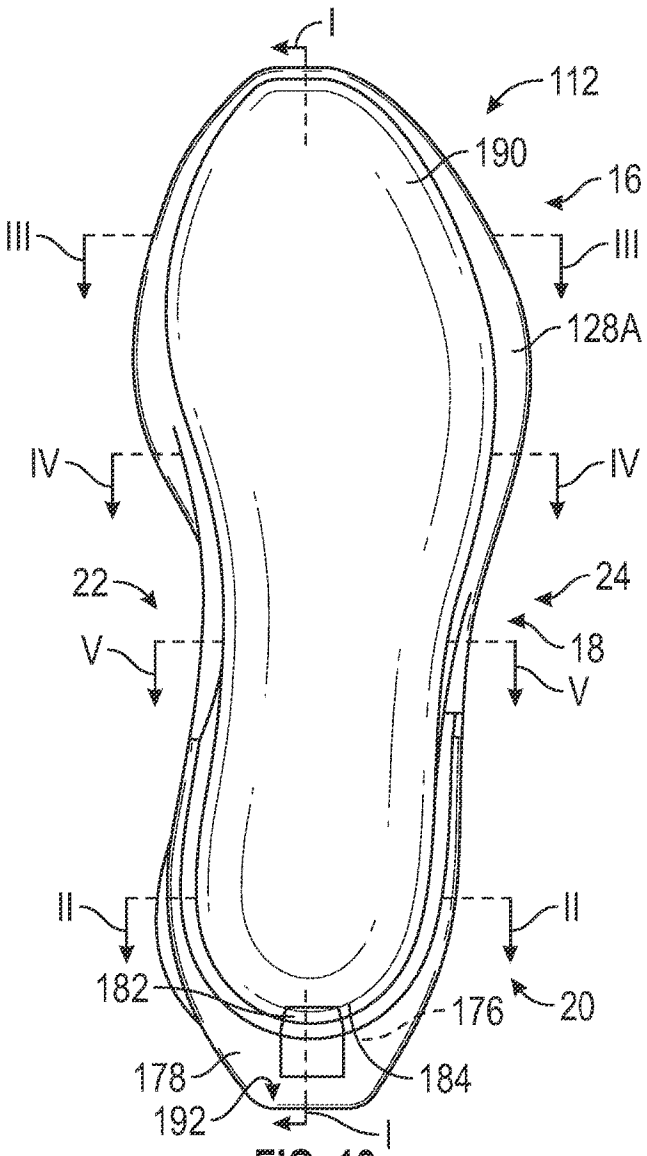
FIG. 10 is a top view of the sole structure of the article of footwear of FIG. 7.
Figure 9:
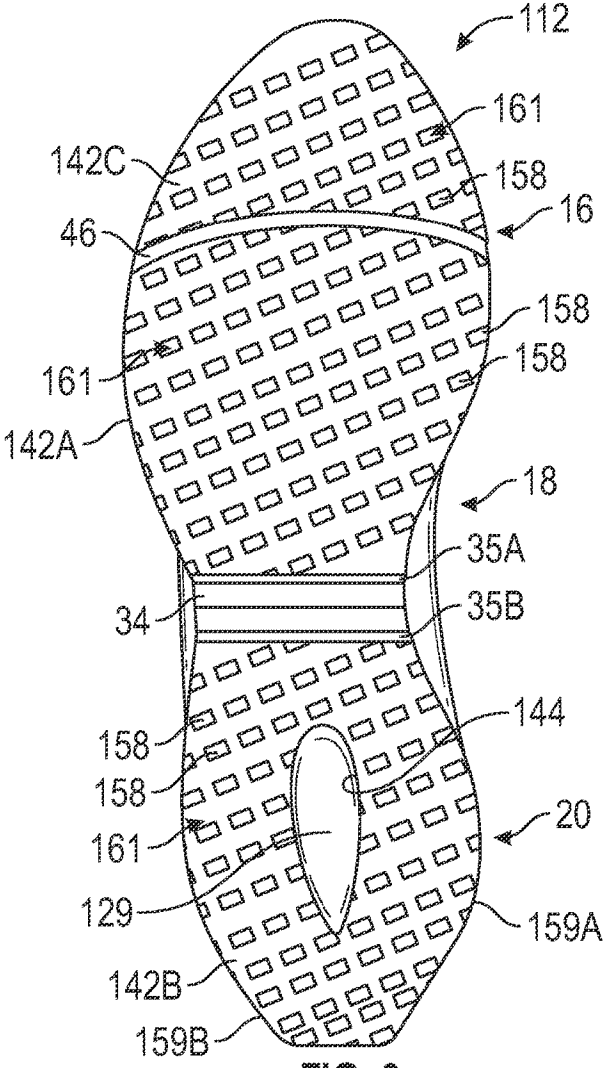
FIG. 9 is a bottom view of the sole structure of the article of footwear of FIG. 7.

FIGS. 7-8 show an article of footwear 110 alike in all aspects to the article of footwear 10 except that the shape of a rear midsole component 128B of the article of footwear 110 is more tapered at the rear than rear midsole component 28B and includes a bottom recess 129 (see FIG. 9), a reinforcing cover 178 extends further around the medial and lateral sides 22, 24 in the heel region 20 on the external ledge 176 than does the reinforcing cover 78 of the article of footwear 10 (as best shown in FIG. 10), and the outsole components 142A, 142B, 142C corresponding with outsole components 42A, 42B, and 42C, respectively, have a slightly differently layout of tread elements 158, as shown in FIG. 9. The rear outsole component 142B includes an aperture 144 at the bottom recess 129. The front outsole component 142A underlies the forward leg 34C of the hinge 34 and the rear outsole component 142B underlies the rear leg 34D.

Figure 11:
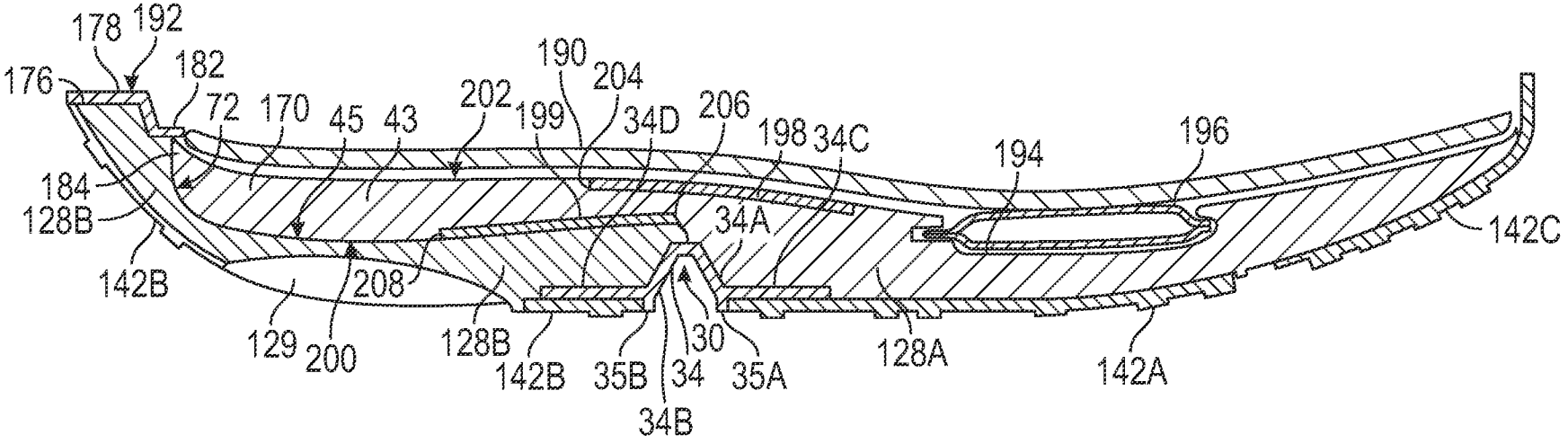
FIG. 11 is a cross-sectional view of the sole structure of the article of footwear of FIG. 7 taken at lines I-I in FIG. 10.

In the cross-sectional view of the hinge 34 shown in FIG. 11, it is apparent that the hinge 34 includes a forward ridge 35A at the intersection of the first wall 34A and the forward leg 34C, and a rear ridge 35B at the intersection of the second wall 34B and the rear leg 34D. The ridges 35A, 35B extend downward and serve as alignment features for securing the front and rear outsole components 142A, 142B to the front and rear legs 34C, 34D. The front outsole component 142A is abutted against the front ridge 35A and the rear outsole component 142B is abutted against the rear ridge 35B to properly align the outsole components 142A, 142B with the hinge 34.

Like the article of footwear 10, the article of footwear 110 is also characterized by an absence of a biasing member configured to maintain the sole structure 112 in one of the use position or the access position (e.g., in a bi-stable arrangement). For example, the footwear upper 14 and the sole structure 112 are characterized by an absence of a biasing member extending between the front upper portion 50A and the rear upper portion 50B, or between the front midsole component 128A and the rear midsole component 128B, or between the front upper portion 50A and the rear midsole component 128B, or between the rear upper portion 50B and the front midsole component 128A. Accordingly, no bands, straps, biasing plates, etc. are included to bias the article of footwear 110 to the use position and/or the access position. Instead, the outsole 142 is characterized by at least a predetermined coefficient of friction (e.g., of static friction or of sliding friction) to maintain the sole structure 112 in the access position. Stated differently, the outsole 142 is of a material and a configuration such that contact of the outsole 142 with the ground surface GS when in the access position like that of the article of footwear 10 in FIG. 3 provides sufficient forces to resist relative movement of the outsole components 142A, 142B, and/or 142C such as sliding of the sole structure 112 on the ground surface GS and preventing the article of footwear 110 from moving to the use position without the loading of an entering foot.

In the access position, the outsole 142 rests on a portion of the rear outsole component 142B and on a portion of the front outsole component 142A and/or the toe region outsole component 142C. By selecting the materials of the outsole 142 to provide at least a predetermined coefficient of friction (e.g., of static friction or of sliding friction) on various selected materials of the ground surface GS, such as typical flooring surfaces, concrete, etc., according to ASTM standardized test(s), no biasing member is needed to maintain the article of footwear 110 in the access position.

In an example, the outsole 142 may be formed from materials that may generally include natural or synthetic rubber or other suitably durable materials. The material or materials for the outsole 142 may be selected to provide a desirable combination of durability, flexibility, and at least the predetermined coefficient of friction discussed herein. Synthetic rubbers that may be used include polybutadiene rubber, ethylene propylene rubber (EPR), styrene isoprene styrene (SIS) copolymer rubber, and styrene butadiene rubber.

Referring again to FIG. 9, the outsole components 142A, 142B, 142C each include a plurality of spaced tread elements 158 only some of which are indicated reference numbers in FIG. 9. The tread elements 158 extend from a medial side edge 159A to a lateral side edge 159B of the sole structure 112 in each of the forefoot region 16, the midfoot region 18, and the heel region 20. The tread elements 158 extend downward and define a portion of the ground engaging surface 161 of the sole structure 112. The tread elements 158 ensure sufficient contact with the ground surface GS of FIG. 8 even in the case of an uneven ground surface. Additionally, the tread elements 158 have sufficient compliance to increase friction relative to a smoother ground-engaging surface that would occur in the absence of tread elements 158.

Similar to the sole structure 12 of the article of footwear 10, the sole structure 112 of the article of footwear 110 includes a midsole 128 that has a front midsole component 128A and a separate rear midsole component 128B. The rear midsole component 128B is separate and divided from the front midsole component 128A. Stated differently, the front midsole component 128A particularly is not integrally formed with, is not unitary with, and/or is not directly attached to the rear midsole component 128B. The front midsole component 28A and the rear midsole component 28B together define a groove 30 at a lower side 32 of the sole structure 112 between the front midsole component 128A and the rear midsole component 128B. The hinge 34 is disposed in the groove 30, as described with respect to the article of footwear 10.

The article of footwear 110 includes the divided footwear upper 14 having a front upper portion 50A and a rear upper portion 50B as described with respect to the article of footwear 10, with the front upper portion 50A secured to the front midsole component 128A, and the separate rear upper portion 50B secured to the rear midsole component 128B.

In FIG. 11, the heel footbed 43 is shown extending over the groove 30, overlaying the rear midsole component 128B, and resting on the portion 45 of the inner surface 72 of the rear midsole component 128B in the use position. A clip 182 projects forward from the inner surface 72 of the rear midsole component 128B and overlays a rear extent 184 of the heel footbed 43 when the sole structure 112 is in the use position, as is evident in FIGS. 10 and 11. The clip 182 flexibly interfaces with the rear extent 184 of the heel footbed 43 when the sole structure 112 moves from the access position (a position like that of FIG. 3) to the use position of FIG. 11 and from the use position to the access position.

In FIG. 11, the clip 182 is an integral portion of the cover 178, at least a portion of which is positioned rearward of the clip 182 along the external ledge 176. As shown in FIG. 11, the integral cover 178 and the integral clip 182 step downward in a forward direction from the foot contact surface 192 of the cover 178 on which the wearer's opposite foot contacts to force the sole structure 112 to the access position. At least partly because the clip 182 is integral with the cover 178, depressing the external ledge 176 and the cover 178 thereon with the opposite foot moves the clip 182 away from the rear extent 184 of the heel footbed 43, allowing the heel footbed 43 to move upward relative to the clip 182 as the sole structure 112 articulates to the access position.

Like the article of footwear 10, interference between the heel collar 60 of the rear upper portion 50B and the heel footbed 43 further enhances the ability to maintain the article of footwear 110 in the access position in the absence of loading of an entering foot.

FIG. 11 shows an insole 190 overlying the front midsole component 128A, including overlying the heel footbed 43. Additionally, the front midsole component 128A is shown with an upward-facing recess 194 in which is housed a fluid-filled bladder 196 to provide cushioning in the metatarsal portion of the forefoot region 16.

The sole structure 112 includes a first plate 198 disposed on or in the heel footbed 43 and extending over the groove 30 in the use position, and a second plate 199 disposed on or in the heel footbed 43 as shown in FIG. 11. The second plate 199 is disposed nearer to a bottom surface 200 of the heel footbed 43 than is the first plate 198, and the first plate 198 is disposed nearer to a top surface 202 of the heel footbed 43 than is the second plate 199. In the specific example shown, the first plate 198 is disposed at the top surface 202 of the heel footbed 43 and the second plate 199 is disposed at the bottom surface 200 of the heel footbed 43. Alternatively, either of both of the plates 198, 199 could be further embedded in the heel footbed rather than exposed at either of the surfaces 200, 202.

The plates 198, 199 may be relatively more rigid than the front midsole component 128A (e.g., than a foam body 170 of the heel footbed 43 of the front midsole component 128A). For example, the first plate 198 may have a first rigidity whereas the front midsole component 128A (including the body 170 of the heel footbed 43) may have a second rigidity less than the first rigidity. Similarly, the second plate 199 may have a rigidity that is greater than the second rigidity of the front midsole component 128A (including the body 170 of the heel footbed 43). The more rigid plates 198, 199 may enable smoother transitioning between the access and use positions, allowing the heel footbed 43 to be more easily seated on the rear midsole component 128B and within the rear upper portion 50B.

The more rigid plates 198, 199 may stiffen the heel footbed 43, which may prevent twisting of the heel footbed 43 about the longitudinal axis of the heel footbed 43, enabling it to move more easily past the rear upper portion 50B and the clip 182, and allowing the attached side tabs 64, 210 to move more easily into and out of the medial-side recess 214 and the lateral-side recess 212, respectively, than would a heel footbed without either of the plates 198, 199 under foot loading on the heel footbed 43 or under a foot removal force on the cover 178 of the ledge 176 as discussed herein to move the sole structure 112 between the access position and the use position.

As shown in FIG. 11, a rear extent 204 of the first plate 198 is disposed rearward of a front extent 206 of the second plate 199 along a length of the heel footbed 43 such that the first plate 198 and the second plate 199 partially overlap (e.g., in the vertical direction of the sole structure 112). Stated differently, a portion of the first plate 198 is stacked above a portion of the second plate 199 with a portion of the rear midsole component 128B therebetween. The first plate 198 spans fore and aft over the entire groove 30 in the use position, and the front extent 206 of the second plate 199 is disposed partially over the groove 30 in the use position. Both the first plate 198 and the second plate 199 at least partially overlay the rear midsole component 128B in the use position. A rear extent 208 of the second plate 199 is disposed forward of the medial-side tab 210 and the lateral-side tab 64 shown and discussed with respect to FIGS. 12-16.

Figure 12:
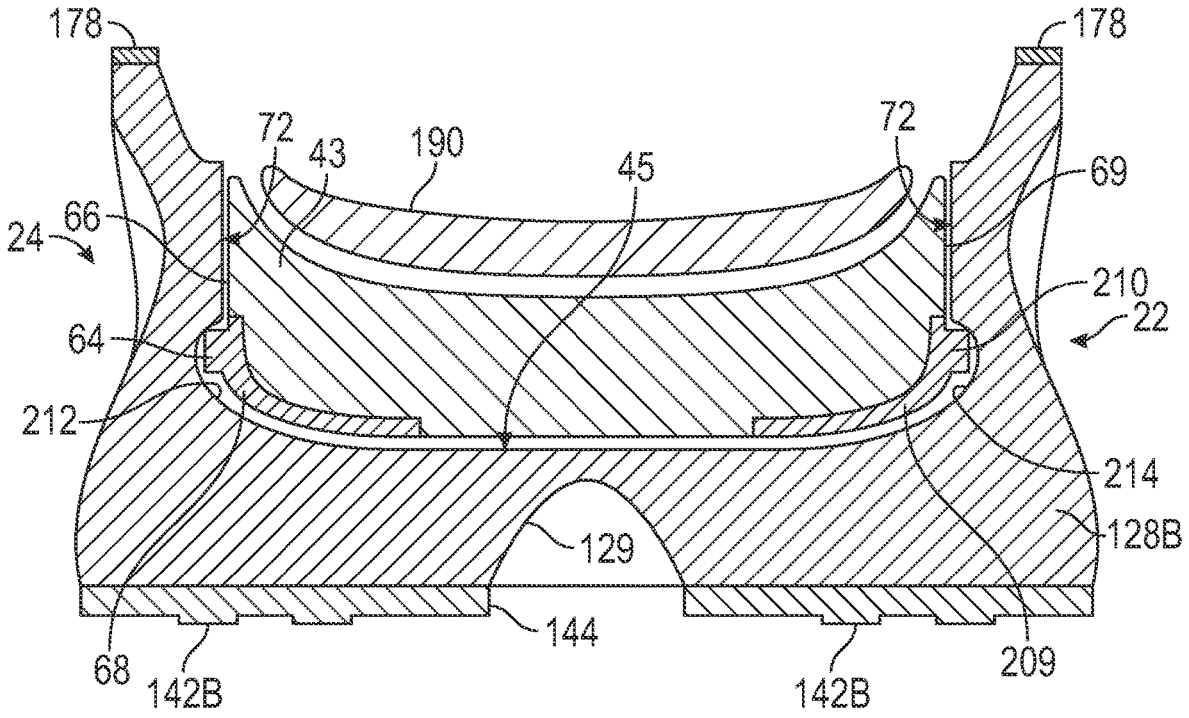
FIG. 12 is a cross-sectional view of the sole structure of the article of footwear of FIG. 7 taken at lines II-II in FIG. 10.
Figure 13:
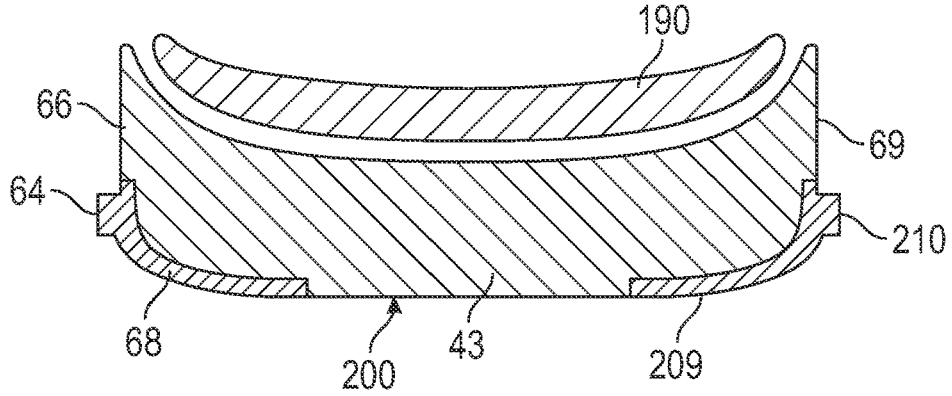
FIG. 13 shows the heel footbed and insole of the sole structure of the cross-sectional view of FIG. 12.
Figure 15:
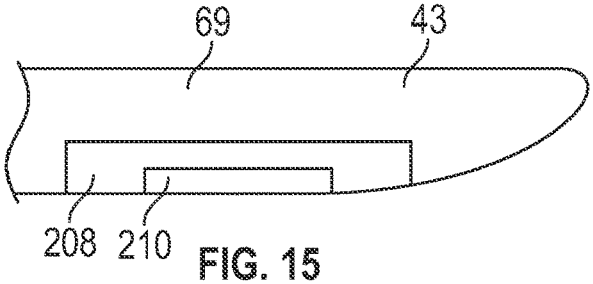
FIG. 15 is a fragmentary side view of the medial side of the heel footbed of the sole structure of the article of footwear of FIG. 7 showing a medial-side stiffening layer including a medial-side protruding tab.
Figure 16:
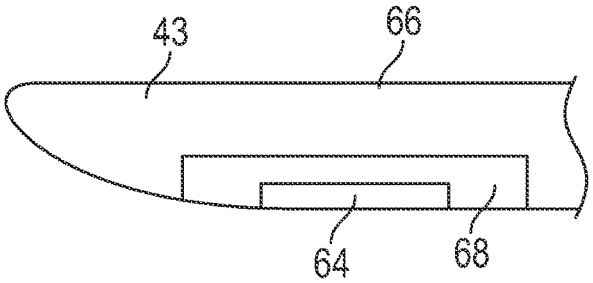
FIG. 16 is a fragmentary side view of the lateral side of the heel footbed of the sole structure of the article of footwear of FIG. 7 showing a lateral-side stiffening layer including a lateral-side protruding tab.

Referring to FIG. 12, the heel footbed 43 includes the lateral-side tab 64 protruding at the lateral-side periphery 66 of the heel footbed 43 and integrally formed with the lateral-side stiffening layer 68 as an integral portion thereof. The lateral-side stiffening layer 68 also extends partway under the heel footbed 43. FIGS. 13 and 15 also show the lateral-side tab 64 and lateral-side stiffening layer 68.

FIG. 12 also shows that the heel footbed 43 includes a medial-side stiffening layer 209 secured at the medial-side periphery 69 of the heel footbed 43 and a medial-side tab 210 as an integral portion of the medial-side stiffening layer 209 and protruding outward at the medial-side periphery 69. Like the lateral-side stiffening layer 68 and lateral-side tab 64, the medial-side stiffening layer 209 and medial-side tab 210 are stiffer than the heel footbed 43.

Figure 14:
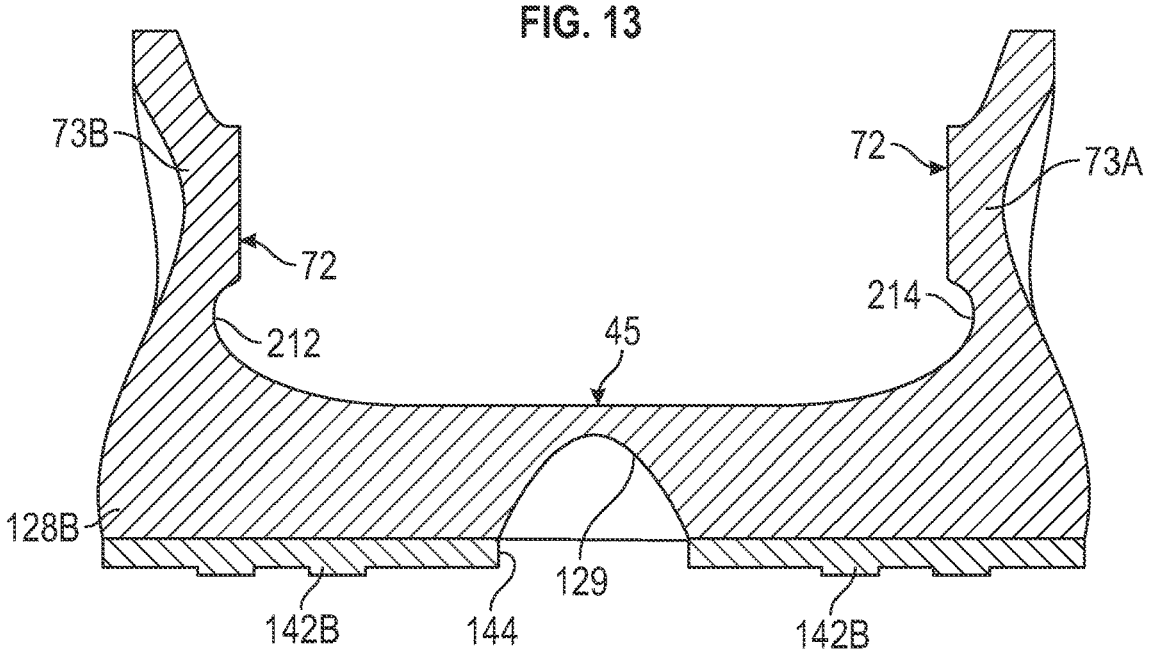
FIG. 14 shows the rear midsole component and outsole of the cross-sectional view of FIG. 12.

FIG. 12 shows the inner surface 72 of the rear midsole component 128B with a lateral-side recess 212 in a lateral side of the inner surface 72, and a medial-side recess 214 in the medial side of the inner surface 72. The recesses 212, 214 are best shown in FIG. 14 and are at the inner side walls 73A, 73B of the rear midsole component 128B. The lateral-side tab 64 is disposed in the lateral-side recess 212 when the sole structure 112 moves to the use position to secure the heel footbed 43 in the use position. Similarly, the medial-side tab 210 is disposed in the medial-side recess 214 when the sole structure 112 moves to the use position to further secure the heel footbed 43 in the use position. More specifically, the lateral-side tab 64 in the lateral-side recess 212 and the similar medial-side tab 210 in the medial-side recess 214 interlock the heel footbed 43 to the rear midsole component 28B at both the medial side 22 and the lateral side 24 to help maintain the article of footwear 110 in the use position.

Figure 17:
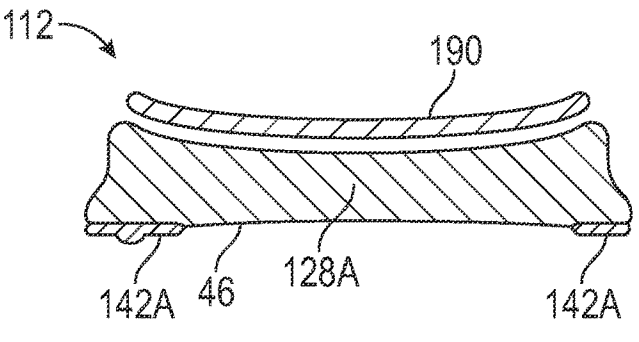
FIG. 17 is a cross-sectional view of the sole structure of the article of footwear of FIG. 7 taken at lines III-III in FIG. 10.

FIG. 17 is a cross-sectional view of the sole structure 112 of the article of footwear 110 taken at lines III-III in FIG. 10 and shows the front midsole component 128A and the insole 190, with the toe region outsole component 142C at the gap 46.

Figure 18:
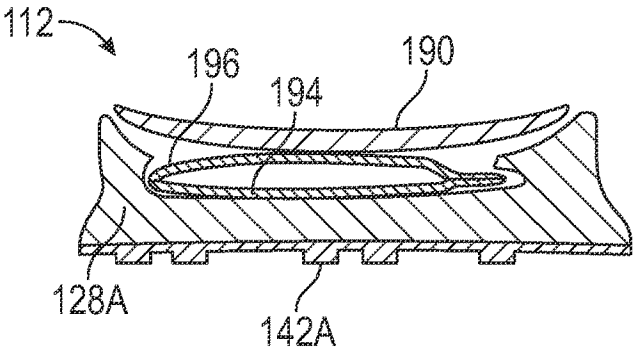
FIG. 18 is a cross-sectional view of the sole structure of the article of footwear of FIG. 7 taken at lines IV-IV in FIG. 10.

FIG. 18 is another cross-sectional view of the sole structure 112 of the article of footwear 110 taken at lines IV-IV in FIG. 10 and shows the bladder 196 in the recess 194 of the front midsole component 128A with the insole 190 overlaying the bladder 196.

Figure 19:
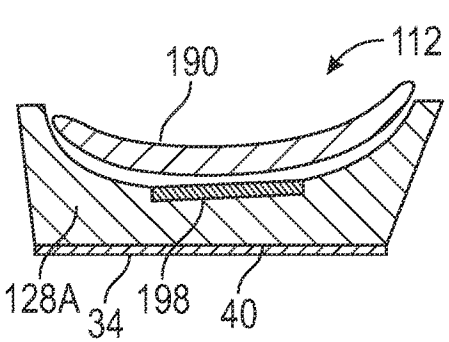
FIG. 19 is a cross-sectional view of the sole structure of the article of footwear of FIG. 7 taken at lines V-V in FIG. 10.

FIG. 19 is another cross-sectional view of the sole structure 112 of the article of footwear 110 taken at lines V-V in FIG. 10 at the peak 40 of the hinge 34 and showing a portion of the first plate 198.

FIGS. 20-25 show an alternative article of footwear 310 (see FIG. 25) and sole structure 312. Various components of the article of footwear 310 and sole structure 312 are alike in many aspects to the articles of footwear 10 and 110 and the sole structures 12 and 112. Like components are indicated with like reference numbers.

Figure 20:
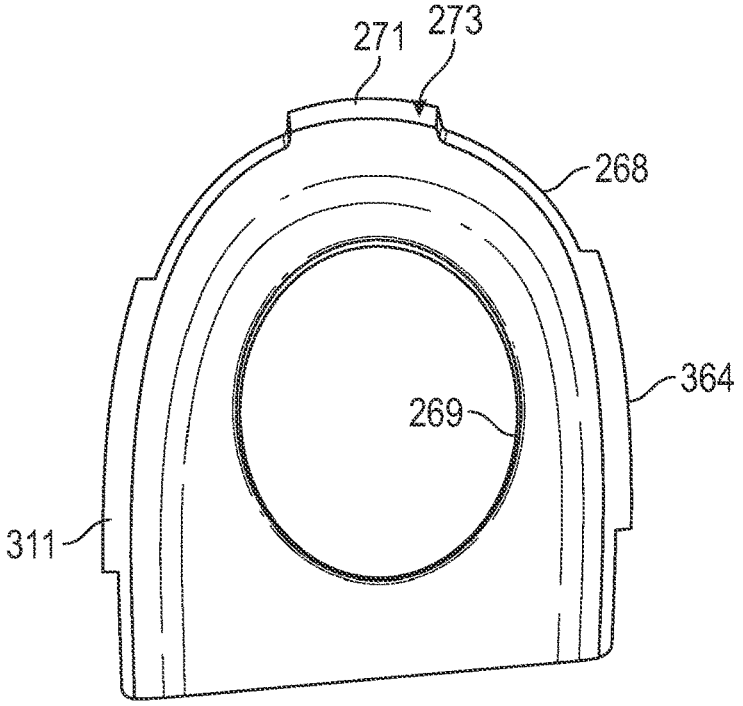
FIG. 20 is a top view of an external stiffening layer for the heel footbed of the front midsole component shown in FIG. 21.
Figure 21:
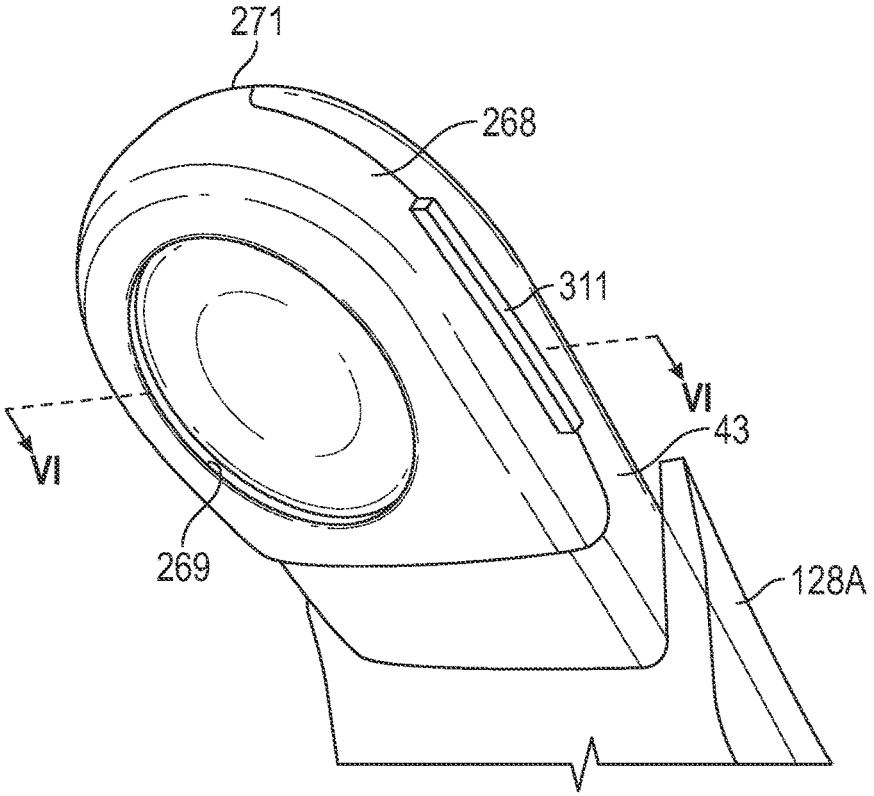
FIG. 21 is a bottom perspective and fragmentary view of a heel footbed of a front midsole component with the external stiffening layer of FIG. 20.

FIG. 20 is a top view of an external stiffening layer 268 for the heel footbed 43 of the front midsole component 128A shown in FIG. 21 and is used in place of the separate stiffening layers 68 and 209 shown in FIG. 12.

The external stiffening layer 268 may be secured to the body 70 of the heel footbed 43 such as with adhesive, or may be coated on the body 70, or otherwise applied to define a portion of the lateral-side periphery 66 of the heel footbed 43, a portion of the medial-side periphery 69 of the heel footbed 43, and a portion of the rear periphery of the heel footbed 43. In one example, the external stiffening layer 268 is molded separately from the body 70 and is then adhered to the body 70. In another example, foam used to form the body 70 may be processed such as by temperature-controlled curing so that the external stiffening layer 268 is an integral external skin of the body 70 that is more dense than a remaining internal portion of the body 70 that it covers.

The external stiffening layer 268 has an integral medial-side tab 311 and an integral lateral-side tab 364. The integral medial-side tab 311 and the integral lateral-side tab 364 are longer than the side tabs 210 and 64 of the sole structure 12 (e.g., extend further in the longitudinal direction of the article of footwear 310 of FIG. 25). The increased length may better maintain the heel footbed 43 interlocked with the rear midsole component 128B in the use position.

The body 70 may be relatively less hard than the external stiffening layer 268 and the integral lateral-side tab 64. For example, the body 70 may have a first hardness and the external stiffening layer 268, the integral medial-side tab 311, and the integral lateral-side tab 364 may have a second hardness greater than the first hardness. For example, the body 70 may be elastomeric foam, as discussed, and the external stiffening layer 268, the integral medial-side tab 311, and the integral lateral-side tab 364 may be a semi-rigid or rigid plastic (such as a thermoplastic), a composite, nylon, a polyether block amide such as PEBAX® available from Arkema, Inc. in King of Prussia, Pennsylvania USA, a fiberglass reinforced polyamide, a rigid thermoplastic polyurethane (with or without glass fiber).

The external stiffening layer 268 defines a through-hole 269 positioned to be aligned with the bottom recess 129 in the rear midsole component 128B when in the use position in order to maintain resilient heel cushioning. The external stiffening layer 268 also defines an integral and upwardly-protruding ledge 271 having an upper surface 273 configured to interface with a lower surface 284 of the integral clip 282 of the peripheral support 283 for the rear midsole component 128B of FIG. 23. This is best shown in the cross-sectional view of FIG. 25. The forward and downward slope of the integral clip 282 helps the ledge 271 to slide over the flexible integral clip 282 when the sole structure moves to the use position, and the interfacing surfaces 273, 284 help to enable the integral clip 282 to maintain the ledge 271 (and the external stiffening layer 268 and rear midsole component 128B connected thereto) below the clip 282 once the rear midsole component 128B moves past the integral clip 282 during foot entry.

The peripheral support 283 may also be referred to as a wall support, an inner wall support, or a peripheral wall support, and is stiffer than the rear midsole component 128B. For example, as described, the rear midsole component 128B may be any of the materials described with respect to the rear midsole component 28B, such as foam, while the peripheral support 283 may be PEBAX® or any of the materials described with respect to the external stiffening layer 268.

The peripheral support 283 extends around the inner surface 72 from the medial side 22 at the medial inner side wall 73A to the lateral side 24 at the lateral inner side wall 73B, and around the rear of the inner surface 72 of the rear midsole component 128B. The peripheral support 283 extends downward at the inner surface 72 at the side walls 73A, 73B and has an edge 285 that is disposed adjacent to the recesses 212, 214 to further define the recesses 212, 214. As shown, the edge 285 is a bottom edge or lower edge of the peripheral support 283 at the recesses 212, 214, and establishes a top boundary of the recesses 212, 214 in which the tabs 364, 311 may be disposed. The tabs 364, 311 are complementary interlocking features with the recesses 212, 214 and the peripheral support 283.

Accordingly, the peripheral support 283 serves to limit the ability of the side walls 73A, 73B of the rear midsole component 128B (shown in FIG. 14) to flex outwardly thus reducing the possibility of the side tabs 364 and 311 coming out of the recesses 212, 214. The peripheral support 283 is shaped to nest against and be secured to the side walls 73A, 73B at the inner surface 72 of the rear midsole component 128B with a lower medial edge 285 disposed adjacent to the medial-side recess 214 to further define the medial-side recess 214 and a lower lateral edge 287 disposed adjacent to the lateral-side recess 212 to further define the lateral-side recess 212. The tabs 364, 311 are thus disposed in the respective recesses 212, 214 under the edges 285, 287 of the peripheral support 283 when the sole structure 312 moves to the use position to secure the heel footbed 43 in the use position.

The peripheral support 283 extends to the forward edges 287, 289 of the side walls 73A, 73B of the rear midsole component 128B and follows the slope of the forward edges 287, 289. Additionally, the peripheral support 283 includes integral feet 293, 295 that interface with and may be fixed to the foot-facing portion 45 of the inner surface 72 of the rear midsole component 128B. By following the forward edges 287, 289 of the side walls 73A, 73B and further extending along the foot-facing portion 45 of the inner surface 72, the peripheral support 283 reduces any twisting or bowing of the rear midsole component. The peripheral support 283 also has an integral cover 378 similar to the cover 178 on which the wearer's opposite foot can press downwards at the external ledge 176 of the rear midsole component 128B to enable the heel footbed 43 and external stiffening layer 268 to move past the clip 282 when returning to the access position.

Figure 22:
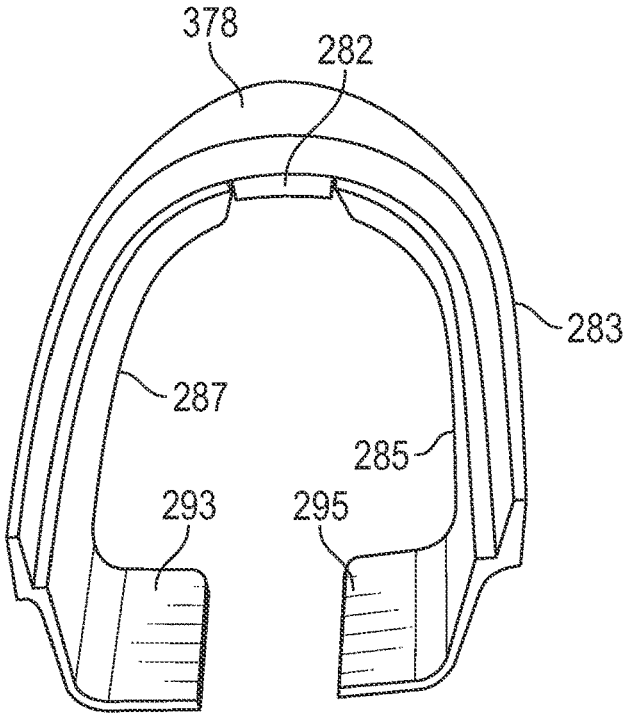
FIG. 22 is a top perspective view of a peripheral support for the rear midsole component of FIG. 23.
Figure 23:
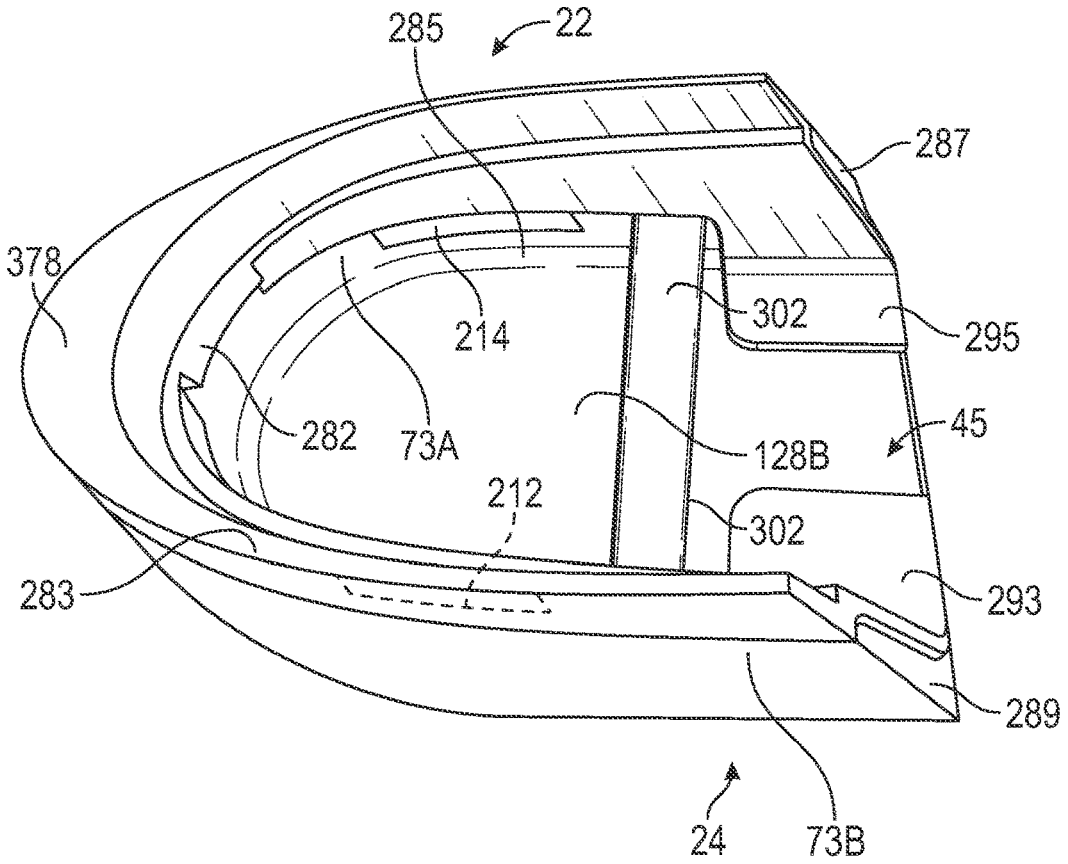
FIG. 23 is a top perspective view of the peripheral support of FIG. 22 extending along the side walls at the inner surface of a rear midsole component and showing a transversely-extending resilient band.
Figure 24:
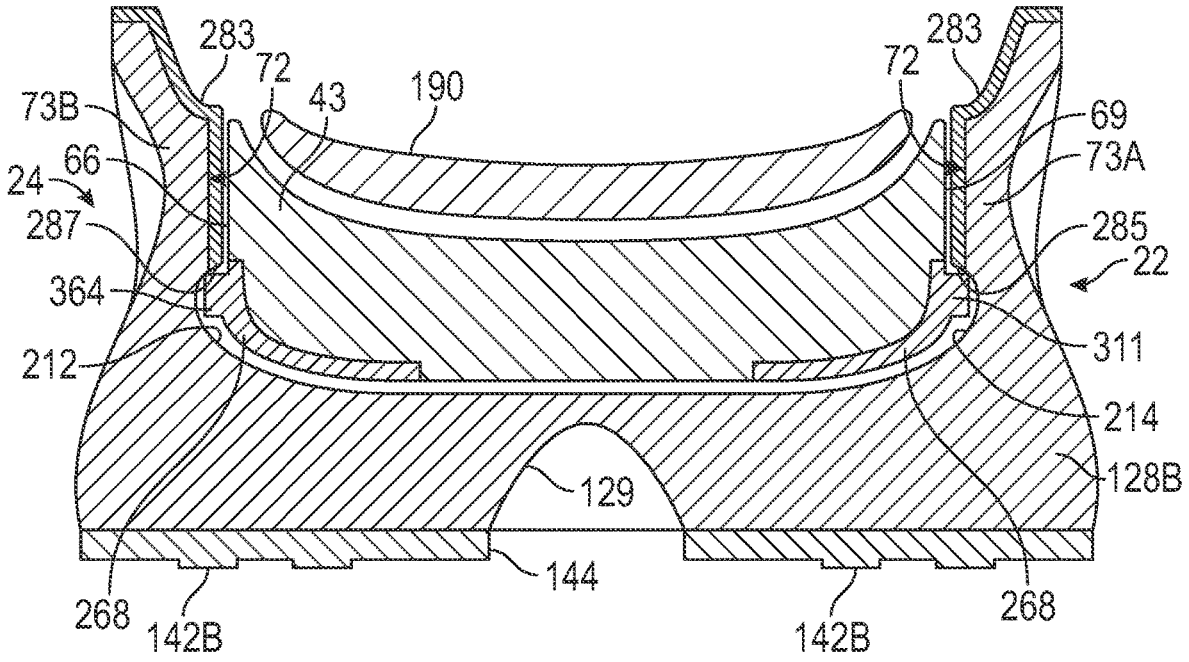
FIG. 24 is a cross-sectional view of the heel footbed and external stiffening layer of FIG. 21 taken at a cross-section indicated by lines VI-VI in FIG. 25 with the side protrusions disposed in recesses of the rear midsole component below the peripheral support of FIG. 23.

FIG. 24 is a cross-sectional view of the heel footbed 43 and the external stiffening layer 268 of FIGS. 20-22 taken at lines VI-VI in FIG. 21 when the side tabs 364, 311 are disposed in recesses 212, 214 of the rear midsole component 128B below the edges 285, 287 of the peripheral support 283 of FIG. 23.

FIG. 23 also shows a transversely-extending resilient band 302 that is secured at the side walls 73A, 73B slightly spaced apart from (e.g., spaced above) the inner surface 72 (e.g., above the foot-facing portion 45 of the inner surface 72) of the rear midsole component 128B. Stated differently, when the rear midsole component 128B is not supporting a foot, the resilient band 302 is spaced above and extends over the foot-facing portion 45 with a gap therebetween (e.g., the resilient band 302 is not touching and not laying on the foot-facing portion 45). The resilient band 302 is sufficiently taut in the state shown in FIG. 23 that it can serve as a resting support that maintains the heel footbed 43 in the access position, like that shown in FIG. 3, for example. Stated differently, the bottom of the heel footbed 43 can rest against and be supported by the resilient band 302 when the sole structure 312 is in the access position.

Figure 25:
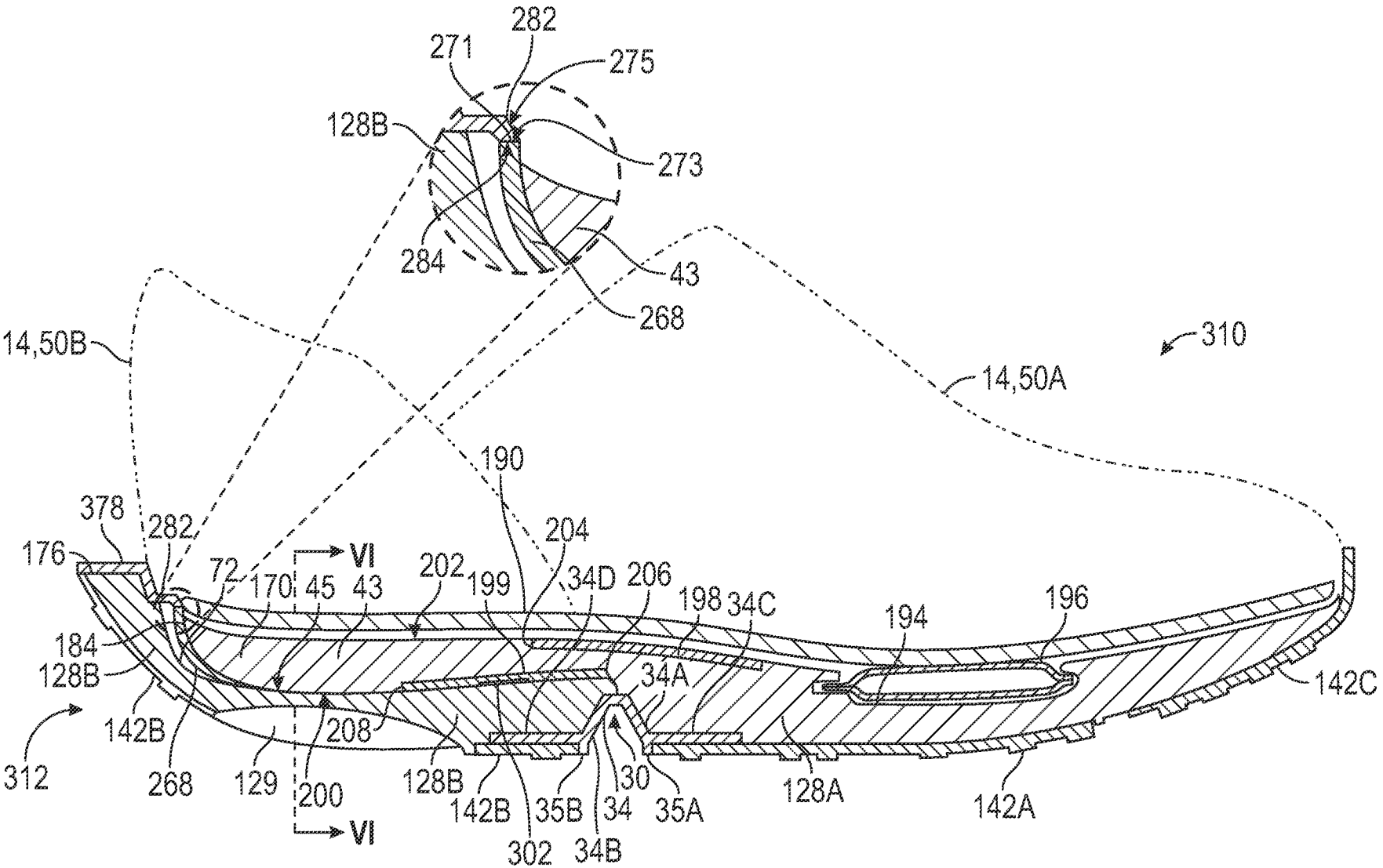
FIG. 25 is a cross-sectional view of an article of footwear taken along a longitudinal midline of the article of footwear and including a divided footwear upper shown in phantom and a sole structure including the front midsole component with the heel footbed and external stiffening layer of FIG. 21 and the rear midsole component and peripheral support of FIG. 23.

During foot entry, when the sole structure 312 moves to the use position, the resilient band 302 resiliently stretches and is moved against the foot-facing portion 45 of the inner surface 72 of the rear midsole component 128B by the heel footbed 43, as shown in FIG. 25. The interlocking of the tabs 364, 311 in the recesses 212, 214, respectively, as well as the integral clip 282 over the ledge 271 maintains the rear midsole component 128B in the use position of FIG. 25. The bias of the resilient band 302 to the position of FIG. 23 does not overcome these features and does not return the sole structure 312 to the access position.

FIG. 25 is a cross-sectional view of the article of footwear 310 including the divided footwear upper 14 with the front upper portion 50A and rear upper portion 50B shown in phantom. The sole structure 312 includes the front midsole component 128A with the heel footbed 43 and external stiffening layer 268 of FIG. 21, and the rear midsole component 128B and peripheral support 283 of FIG. 23. It is clear in the close-up view shown at 25A in FIG. 25 that the integral clip 282 has a slightly downward slope in a forward direction at its upper surface 275 that interfaces with the external stiffening layer 268 as the sole structure 312 moves to the use position. This cases sliding of the external stiffening layer 268 past the clip 282 to the use position. The lower surface 284 of the clip 282 is configured to interface with the upper surface 273 of the ledge 271. For example, they may each have relatively flat surfaces or sloped surfaces configured to interface. The interfacing surfaces 273, 284 help maintain the external stiffening layer 268 and the heel footbed 43 below the clip 282 in the use position.

Accordingly, the articles of footwear 10, 110, and 310 disclosed herein provide easy access for foot insertion and foot removal without the use of any band or other biasing member to maintain the sole structure 12, 112 in either the use position or the access position. The article of footwear 310 utilizes the transversely-extending resilient band 302 to help support the heel footbed 43 in the access position, but includes no band or other biasing member that extends between the front upper portion 50A and the rear upper portion 50B, or between the front midsole component 128A and the rear midsole component 128B, or between the front upper portion 50A and the rear midsole component 128B, or between the rear upper portion 50B and the front midsole component 128A to move the sole structure 312 in the access position or in the use position.

The following Clauses provide example configurations of articles of footwear disclosed herein.

Clause 1. An article of footwear comprising: a sole structure including: a front midsole component and a separate rear midsole component, the front midsole component and the rear midsole component together defining a groove at a lower side of the sole structure between the front midsole component and the rear midsole component; and a hinge disposed in the groove and connecting the front midsole component to the rear midsole component; wherein: the front midsole component and the rear midsole component are pivotable relative to one another at the groove between a use position and an access position with the groove relatively open in the use position and relatively closed in the access position; the front midsole component includes a heel footbed that extends over the groove and overlays the rear midsole component in the use position, and is spaced apart from the rear midsole component in the access position; and the rear midsole component includes an inner surface with a recess in a side of the inner surface; the sole structure further including a tab protruding at a side periphery of the heel footbed; and wherein the tab is disposed in the recess when the sole structure moves to the use position to secure the heel footbed in the use position.

Clause 2. The article of footwear of clause 1, wherein: the sole structure further comprises a stiffening layer secured at the side periphery of the heel footbed; and the stiffening layer is stiffer than the heel footbed and includes the tab.

Clause 3. The article of footwear of any of clauses 1-2, wherein: the side of the inner surface of the rear midsole component is a lateral side; the recess is a lateral-side recess; the side periphery of the heel footbed is a lateral-side periphery; and the tab is a lateral-side tab.

Clause 4. The article of footwear of clause 3, wherein: the rear midsole component further includes a medial side recess along a medial side of the inner surface; the heel footbed includes a medial side tab protruding at a medial side periphery of the heel footbed; and the medial side tab is disposed in the medial side recess when the sole structure moves to the use position to further secure the heel footbed in the use position.

Clause 5. The article of footwear of any of clauses 1-4, wherein: the side of the inner surface of the rear midsole component is a medial side; the recess is a medial side recess; the side periphery of the heel footbed is a medial side periphery; and the tab is a medial side tab.

Clause 6. The article of footwear of any of clauses 1-5, wherein: a clip projects forward from the inner surface of the rear midsole component; the clip overlays a rear extent of the heel footbed when the sole structure is in the use position; and the clip flexibly interfaces with the rear extent of the heel footbed when the sole structure moves from the access position to the use position and from the use position to the access position.

Clause 7. The article of footwear of clause 6, wherein a rear extent of the rear midsole component defines an external ledge positioned rearward of the clip such that depressing the external ledge moves the clip away from the rear extent of the heel footbed.

Clause 8. The article of footwear of clause 7, further comprising: a cover disposed on the external ledge; wherein the cover is integral with the clip.

Clause 9. The article of footwear of any of clauses 1-8, the sole structure further comprising: a first plate disposed on or in the heel footbed and extending over the groove in the use position; and a second plate disposed on or in the heel footbed, the second plate disposed nearer to a bottom surface of the heel footbed than the first plate, and the first plate disposed nearer to a top surface of the heel footbed than the second plate.

Clause 10. The article of footwear of clause 9, wherein a rear extent of the first plate is disposed rearward of a front extent of the second plate along a length of the heel footbed such that the first plate and the second plate partially overlap.

Clause 11. The article of footwear of clause 10, wherein the first plate is disposed at the top surface of the heel footbed and the second plate is disposed at the bottom surface of the heel footbed.

Clause 12. The article of footwear of any of clauses 10-11, wherein the front extent of the second plate is disposed partially over the groove in the use position.

Clause 13. The article of footwear of any of clauses 10-12, wherein both the first plate and the second plate at least partially overlay the rear midsole component in the use position.

Clause 14. The article of footwear of any of clauses 10-13, wherein a rear extent of the second plate is disposed forward of the tab.

Clause 15. The article of footwear of any of clauses 1-14, wherein: the front midsole component includes a first wall defining a front of the groove; the rear midsole component includes a second wall defining a rear of the groove; and the hinge lines the first wall and the second wall and defines a peak therebetween, the hinge flexing at the peak when the sole structure moves between the use position and the access position.

Clause 16. The article of footwear of clause 15, wherein: the hinge includes a forward leg extending forward from the first wall; and the hinge includes a rear leg extending rearward from the second wall.

Clause 17. The article of footwear of clause 16, wherein the sole structure further includes an outsole secured to a bottom surface of the front midsole component and to a bottom surface of the rear midsole component.

Clause 18. The article of footwear of clause 17, wherein the outsole includes: a front outsole component secured to the bottom surface of the front midsole component and to the forward leg of the hinge; and a rear outsole component discrete and separate from the front outsole component; wherein the rear outsole component is secured to the bottom surface of the rear midsole component and to the rear leg of the hinge.

Clause 19. The article of footwear of any of clauses 1-18, further comprising: a divided footwear upper secured to the sole structure to define a foot-receiving cavity; wherein the divided footwear upper includes a front upper portion secured to the front midsole component, and a separate rear upper portion secured to the rear midsole component; and wherein the sole structure is characterized by an absence of a biasing member extending between the front upper portion and the rear upper portion, and the absence of a biasing member extending between the front midsole component and the rear midsole component, and the absence of a biasing member extending between the front upper portion and the rear midsole component, and the absence of a biasing member extending between the rear upper portion and the front midsole component.

Clause 20. The article of footwear of clause 19, wherein: the rear upper portion includes at least a portion of a heel collar; and the heel collar is configured to support the heel footbed in the access position and resiliently deform to permit the heel footbed to move past the heel collar to the use position.

Clause 21. The article of footwear of any of clauses 1-20, wherein: the sole structure further includes an outsole secured a bottom surface of the front midsole component and to a bottom surface of the rear midsole component; and the outsole is characterized by at least a predetermined coefficient of friction to maintain the sole structure in the access position.

Clause 22. An article of footwear comprising: a sole structure including: a front midsole component and a separate rear midsole component, the front midsole component and the rear midsole component together defining a groove at a lower side of the sole structure between the front midsole component and the rear midsole component; and a hinge disposed in the groove and connecting the front midsole component to the rear midsole component; wherein the front midsole component and the rear midsole component are pivotable relative to one another at the groove between a use position and an access position with the groove relatively open in the use position and relatively closed in the access position; and wherein the article of footwear is characterized by an absence of a biasing member configured to maintain the sole structure in the use position or in the access position.

Clause 23. The article of footwear of clause 22, further comprising: a divided footwear upper secured to the sole structure to define a foot-receiving cavity, the divided footwear upper including a front upper portion secured to the front midsole component, and a separate rear upper portion secured to the rear midsole component; wherein the article of footwear is characterized by an absence of a biasing member extending between the front upper portion and the rear upper portion, and the absence of a biasing member extending between the front midsole component and the rear midsole component, and the absence of a biasing member extending between the front upper portion and the rear midsole component, and the absence of a biasing member extending between the rear upper portion and the front midsole component.

Clause 24. The article of footwear of any of clauses 22-23, the sole structure further comprising: an outsole secured a bottom surface of the front midsole component and to a bottom surface of the rear midsole component; wherein the outsole is characterized by at least a predetermined coefficient of friction to maintain the sole structure in the access position.

Clause 25. The article of footwear of any of clauses 22-24, further comprising: a divided footwear upper secured to the sole structure to define a foot-receiving cavity, the divided footwear upper including a front upper portion secured to the front midsole component, and a separate rear upper portion secured to the rear midsole component; wherein: the rear upper portion includes at least a portion of a heel collar; the front midsole component includes a heel footbed that extends over the groove and overlays the rear midsole component in the use position, and is spaced apart from the rear midsole component in the access position; and the heel collar is configured to support the heel footbed in the access position and resiliently deform to permit the heel footbed to move past the heel collar to the use position.

Clause 26. An article of footwear comprising: a sole structure including: a front midsole component and a separate rear midsole component, the front midsole component and the rear midsole component together defining a groove at a lower side of the sole structure between the front midsole component and the rear midsole component; and a hinge disposed in the groove and connecting the front midsole component to the rear midsole component; wherein: the front midsole component and the rear midsole component are pivotable relative to one another at the groove between a use position and an access position with the groove relatively open in the use position and relatively closed in the access position; the front midsole component includes a heel footbed that extends over the groove and overlays the rear midsole component in the use position, and is spaced apart from the rear midsole component in the access position; the rear midsole component includes an inner surface; and a side of the heel footbed and the inner surface of the rear midsole component include complementary interlocking features that secure the heel footbed in the use position.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where an outsole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure including:

a front midsole component and a separate rear midsole component, the front midsole component and the rear midsole component together defining a groove at a lower side of the sole structure between the front midsole component and the rear midsole component;

a divided footwear upper secured to the sole structure to define a foot-receiving cavity; and a hinge disposed in the groove and connecting the front midsole component to the rear midsole component;

wherein:

the divided footwear upper includes a front upper portion secured to the front midsole component, and a separate rear upper portion secured to the rear midsole component;

the front midsole component and the rear midsole component are pivotable relative to one another at the groove between a use position and an access position with the groove relatively open in the use position and relatively closed in the access position;

the front midsole component includes a heel footbed that extends over the groove and overlays the rear midsole component in the use position, and is spaced apart from the rear midsole component in the access position;

the rear midsole component includes an inner surface and at least partially defines a recess at the inner surface;

the sole structure further including a tab protruding at a side periphery of the heel footbed;

wherein the tab is disposed in the recess when the sole structure moves to the use position to secure the heel footbed in the use position; and wherein the sole structure is characterized by an absence of a biasing member extending between and connecting the front upper portion and the rear upper portion, and the absence of a biasing member extending between and connecting the front midsole component and the rear midsole component, and the absence of a biasing member extending between and connecting the front upper portion and the rear midsole component, and the absence of a biasing member extending between and connecting the rear upper portion and the front midsole component.

2. The article of footwear of claim 1, wherein:

the sole structure further comprises a stiffening layer secured at the side periphery of the heel footbed; and the stiffening layer is stiffer than the heel footbed and includes the tab.

3. The article of footwear of claim 1, wherein:

the recess is a lateral-side recess at a lateral side of the inner surface, the side periphery of the heel footbed is a lateral-side periphery, and the tab is a lateral-side tab;

the rear midsole component at least partially defines a medial-side recess at a medial side of the inner surface;

the sole structure further includes a medial-side tab protruding at a medial-side periphery of the heel footbed; and wherein the medial-side tab is disposed in the medial-side recess when the sole structure moves to the use position to further secure the heel footbed in the use position.

4. The article of footwear of claim 3, wherein:

the sole structure further comprises a stiffening layer secured at the side periphery of the heel footbed; and the lateral-side tab and the medial-side tab are integral with the stiffening layer.

5. The article of footwear of claim 1, further comprising:

a peripheral support secured to the rear midsole component and having an edge disposed adjacent to the recess to further define the recess;

wherein the peripheral support is stiffer than the rear midsole component; and wherein the tab is disposed in the recess under the edge of the peripheral support when the sole structure moves to the use position to secure the heel footbed in the use position.

6. The article of footwear of claim 5, wherein:

the peripheral support includes an integral clip that projects forward from the inner surface of the rear midsole component;

the clip overlays a rear extent of the heel footbed when the sole structure is in the use position; and the clip flexibly interfaces with the heel footbed when the sole structure moves from the access position to the use position and from the use position to the access position.

7. The article of footwear of claim 1, wherein:

a clip projects forward from the inner surface of the rear midsole component; and the clip overlays a rear extent of the heel footbed when the sole structure is in the use position.

8. The article of footwear of claim 7, wherein a rear extent of the rear midsole component defines an external ledge positioned rearward of the clip such that depressing the external ledge moves the clip away from the rear extent of the heel footbed.

9. The article of footwear of claim 8, further comprising:

a cover disposed on the external ledge; and wherein the cover is integral with the clip.

10. The article of footwear of claim 1, the sole structure further comprising:

a first plate disposed on or in the heel footbed and extending over the groove in the use position; and a second plate disposed on or in the heel footbed, the second plate disposed nearer to a bottom surface of the heel footbed than the first plate, and the first plate disposed nearer to a top surface of the heel footbed than the second plate.

11. The article of footwear of claim 10, wherein a rear extent of the first plate is disposed rearward of a front extent of the second plate along a length of the heel footbed such that the first plate and the second plate partially overlap.

12. The article of footwear of claim 11, wherein the first plate is disposed at the top surface of the heel footbed and the second plate is disposed at the bottom surface of the heel footbed.

13. The article of footwear of claim 11, wherein the front extent of the second plate is disposed partially over the groove in the use position.

14. The article of footwear of claim 11, wherein both the first plate and the second plate at least partially overlay the rear midsole component in the use position.

15. The article of footwear of claim 11, wherein a rear extent of the second plate is disposed forward of the tab.

16. The article of footwear of claim 1, further comprising:

a resilient band suspended over and extending transversely across a portion of the inner surface of the rear midsole component;

wherein, in the access position, the resilient band is spaced apart from the portion of the inner surface of the rear midsole component and the heel footbed rests on the resilient band; and wherein, in the use position, the resilient band resiliently stretches under load and the heel footbed rests on the inner surface of the rear midsole component.

17. The article of footwear of claim 1, wherein:

the front midsole component includes a first wall defining a front of the groove;

the rear midsole component includes a second wall defining a rear of the groove; and the hinge lines the first wall and the second wall and defines a peak therebetween, the hinge flexing at the peak when the sole structure moves between the use position and the access position.

18. An article of footwear comprising:

a sole structure including:

a front midsole component and a separate rear midsole component, the front midsole component and the rear midsole component together defining a groove at a lower side of the sole structure between the front midsole component and the rear midsole component; and a hinge disposed in the groove and connecting the front midsole component to the rear midsole component; and a resilient band suspended over and extending transversely across a portion of an inner surface of the rear midsole component;

wherein:

the front midsole component and the rear midsole component are pivotable relative to one another at the groove between a use position and an access position with the groove relatively open in the use position and relatively closed in the access position;

the front midsole component includes a heel footbed that extends over the groove and overlays the rear midsole component in the use position, and is spaced apart from the rear midsole component in the access position;

the rear midsole component includes an inner surface;

a side of the heel footbed and the inner surface of the rear midsole component include complementary interlocking features that secure the heel footbed in the use position;

in the access position, the resilient band is spaced apart from the portion of the inner surface of the rear midsole component and the heel footbed rests on the resilient band; and in the use position, the resilient band stretches under load and the heel footbed further rests on the inner surface of the rear midsole component.

19. An article of footwear comprising:

a sole structure including:

a front midsole component and a rear midsole component, the front midsole component and the rear midsole component together defining a groove at a lower side of the sole structure between the front midsole component and the rear midsole component;

wherein the front midsole component and the rear midsole component are pivotable relative to one another at the groove between a use position and an access position with the groove relatively open in the use position and relatively closed in the access position;

wherein the front midsole component includes a heel footbed that extends over the groove and overlays the rear midsole component in the use position, and is spaced apart from the rear midsole component in the access position;

wherein the rear midsole component includes an inner surface and at least partially defines a recess at the inner surface;

a tab protruding at a periphery of the heel footbed;

a peripheral support secured to the rear midsole component and having an edge disposed adjacent to the recess to further define the recess, the peripheral support including an integral clip that projects forward from the inner surface of the rear midsole component, and the peripheral support further including an integral cover disposed on an external ledge of a rear extent of the rear midsole component and positioned rearward of the clip;

wherein the clip overlays a rear extent of the heel footbed when the sole structure is in the use position; and wherein the clip flexibly interfaces with the heel footbed when the sole structure moves from the use position to the access position when the external ledge is depressed at the cover to move the clip away from the rear extent of the heel footbed.

20. The article of footwear of claim 19, wherein the peripheral support includes integral feet that interface with a foot-facing portion of the inner surface of the rear midsole component.

* * * * *